US007119699B2

(12) United States Patent
King et al.

(10) Patent No.: US 7,119,699 B2
(45) Date of Patent: Oct. 10, 2006

(54) LIQUID SENSOR DEVICE, SYSTEM AND METHOD

(75) Inventors: Patrick F. King, Glen Ellyn, IL (US); Myron P. Andersen, Glen Ellyn, IL (US)

(73) Assignee: Glen Ellyn Industries, LLC, Glen Ellyn, IL (US)

( * ) Notice: Subject to any disclaimer, the term of this patent is extended or adjusted under 35 U.S.C. 154(b) by 217 days.

(21) Appl. No.: 10/887,459

(22) Filed: Jul. 8, 2004

(65) Prior Publication Data

US 2005/0024214 A1 Feb. 3, 2005

Related U.S. Application Data

(60) Provisional application No. 60/485,458, filed on Jul. 8, 2003.

(51) Int. Cl.
*G08B 21/00* (2006.01)

(52) U.S. Cl. ..... 340/618; 340/602; 340/604; 340/605; 340/573.6

(58) Field of Classification Search ..... 340/618, 340/602, 603, 604, 605, 611, 614, 626, 686.1, 340/573.5, 573.6; 73/46, 40.5 R; 251/68
See application file for complete search history.

(56) References Cited

U.S. PATENT DOCUMENTS 4,169,261 A * 9/1979 Alpaugh ..... 340/602
5,966,076 A * 10/1999 Cantrell ..... 340/605
6,025,788 A * 2/2000 Diduck ..... 340/870.16
6,112,580 A * 9/2000 Hesky ..... 73/49.1

* cited by examiner

*Primary Examiner*—Hung Nguyen
(74) *Attorney, Agent, or Firm*—Withrow & Terranova, PLLC

(57) ABSTRACT

A liquid sensor device, system and method depends on the structural deformation of a trigger material in contact with a liquid, such as water, to convert potential energy of a resilient material to kinetic energy that triggers a mechanical response in an activated state. A transfer arm is biased toward the activated state and may be retained in a deactivated state, against urging of a spring, by a trigger material that may be structurally rigid while substantially dry. Upon contact with a liquid, such as water, the trigger material may relinquish structural rigidity and be substantially deformed. Upon substantial deformation of the trigger material, the transfer arm may be urged into the activated state by activating a locking mechanism or electronically, such as by activating a switch such as a micro switch. In the activated state, the triggered mechanical response may activate an alarm, and may trigger an electrical response to close a valve, such as a natural gas valve on a gas-heated hot water tank.

73 Claims, 18 Drawing Sheets

LIQUID SENSOR DEVICE, SYSTEM AND METHOD

RELATED APPLICATION

This application claims the benefit and priority of U.S. Provisional Patent Application No. 60/485,458 entitled "Water sensor device, system and method" filed on Jul. 8, 2003, which is incorporated by reference herein in its entirety.

FIELD OF THE INVENTION

The present invention relates to a liquid detection device, system and method. More particularly, the present invention relates to a liquid sensor that senses the presence of water or other liquid over a surface.

BACKGROUND OF THE INVENTION

It is often desired to detect the presence of a liquid over a surface, particularly when the presence of the liquid may indicate an undesired leak that may need attention and repair. A typical example is detecting the presence of water over a floor surface upon which an appliance such as a hot water tank may be located. Typically, hot water tanks are located in out-of-the-way or even hidden places, such as basements, closets and attics, for example, where an undetected water leak may cause substantial water damage to the building that houses the hot water tank. Sump pumps may be employed to actively remove water caused by a leak. Moreover, to prevent potential fire or explosion damage in the example of a gas-heated hot water tank that burns a flammable gas, one may desire to extinguish the burning gas should an undetected water leak drain the water tank.

Many water sensors detect water that rises to a predetermined level in a holding tank, for example. These water sensors typically utilize a float, which activates a switch and an alarm. However, a problem with these types of float sensors is that the sensor typically must be in contact with water during normal operation. Therefore, the sensor is built into or otherwise made a part of the holding tank, sometimes at significant cost. Moreover, these water sensors are not useful in undefined spaces that may not reliably contain the leaking water, such as in a room or attic, or on a platform, table or raised surface, for example.

Other water sensors sound an alarm when a sponge-like material absorbs water and closes an electrical circuit. These water sensors are dependent on electrical power and tend to be unreliable when the electrical power fails or a battery fails that is required to constantly change the cathode and anode that close a circuit when immersed in a pool or puddle of liquid, such as water.

Consequently, a need exists for providing a water sensor that detects the presence of water over a surface, independent of any need for electrical power or a float that must maintain contact with water during operation.

SUMMARY OF THE INVENTION

Those skilled in the art will appreciate the scope of the present invention and realize additional aspects thereof after reading the following detailed description of the preferred embodiments in association with the accompanying drawing figures.

Briefly described, according to one embodiment of the present invention, a liquid or water sensor is provided that depends on the structural deformation of a trigger material in contact with a liquid, such as water. The sensor is located on an undefined space that may not reliably contain the water, thereby to convert potential energy of a resilient spring to kinetic energy that is used to activate a mechanical response, such as activating an audible alarm or causing a secondary reaction.

The water sensor includes a transfer arm, a spring, a trigger material, a locking apparatus and a signaling apparatus, such as an alarm, a switch, a micro switch, or communication circuit either wired or wireless, such as a Bluetooth communication circuit, WiFi circuit, or shut-off valves for gas, water, or electricity, for example. The spring biases the transfer arm into immobilized contact with the trigger material, which is structurally rigid while substantially dry. Upon contact and wetting with a liquid, such as water, the trigger material relinquishes structural rigidity and may be substantially deformed. The spring moves the transfer arm through the wet and substantially deformed trigger material, thereby causing the mechanical response such as activating the signaling apparatus to produce an audible sound.

Moreover, the mechanical response may cause an electrical response, such as activating an electrical switch coupled to a solenoid or micro switch, which may close a valve to natural gas being distributed to a gas-heated hot water tank or activate an alarm or notification, for example. The locking apparatus provides a locked position, thereby immobilizing the transfer arm while the trigger material is removed for service, for example.

In another embodiment, a water sensor is provided, comprising a base having a first side and a second side; an orifice defined by the base; a retaining member affixed to the first side of the base, proximate to the orifice; a trigger material deformable by contact with water, retained beneath the orifice by the retaining member; a transfer arm affixed to the second side of the base and protruding through the orifice, biased into contact with and immobilized by the trigger material, thereby retaining potential energy; a signaling apparatus affixed to the second side of the base proximate to the transfer arm and activated by movement of the transfer arm, thereby transmitting a signal upon activation; and whereby upon water contact with the trigger material, the trigger material deforms and the transfer arm moves toward the trigger material, thereby activating the signaling apparatus to transmit the signal.

In another embodiment, a method is provided for sensing the presence of water wherein the method comprises retaining a trigger material, deformable by contact with water, in a fixed position beneath an orifice defined by a base; biasing a transfer arm, affixed to the base and protruding through the orifice, into contact with and immobilized by the trigger material, thereby retaining potential energy; contacting the trigger material with water; deforming the trigger material upon contact with the water; moving the transfer arm toward the trigger material upon deformation of the trigger material, thereby converting the potential energy to kinetic energy; activating a signaling apparatus, affixed to the base proximate to the transfer arm, with the kinetic energy upon movement of the transfer arm; and transmitting a signal upon activation of the signaling apparatus.

In another embodiment, micro switches are utilized in the water sensor. The water sensor includes a transfer arm that either releases a spring under tension or under compression, depending on design. The energy is released when the trigger material comes into contact with water or other liquid and the trigger material holds a pin in place connected to the transfer arm. When the pin is released due to the softening of the trigger material, the transfer arm moves to release the energy in the spring thereby causing the transfer arm to activate one or more micro switches. In one embodiment, there are two micro switches, where on micro switch activates an alarm, and the other micro switch causes connections at a terminal block for a contact to be detected by an external system, such as an alarm or monitoring system, which may be located in close proximity or remotely from the water sensor.

The water sensor may be designed so that softening of the trigger material causes the transfer arm to release energy in the spring to activate a micro switch, or that expansion of the trigger material moves the transfer arm to contact the micro switch. The trigger material may be selected from those that expand when coming into contact with water or other liquid rather than softening or losing its rigidity.

BRIEF DESCRIPTION OF THE DRAWINGS

The accompanying drawing figures incorporated in and forming a part of this specification illustrate several aspects of the invention, and together with the description serve to explain the principles of the invention.

DETAILED DESCRIPTION OF THE PREFERRED EMBODIMENTS

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Figure 1:
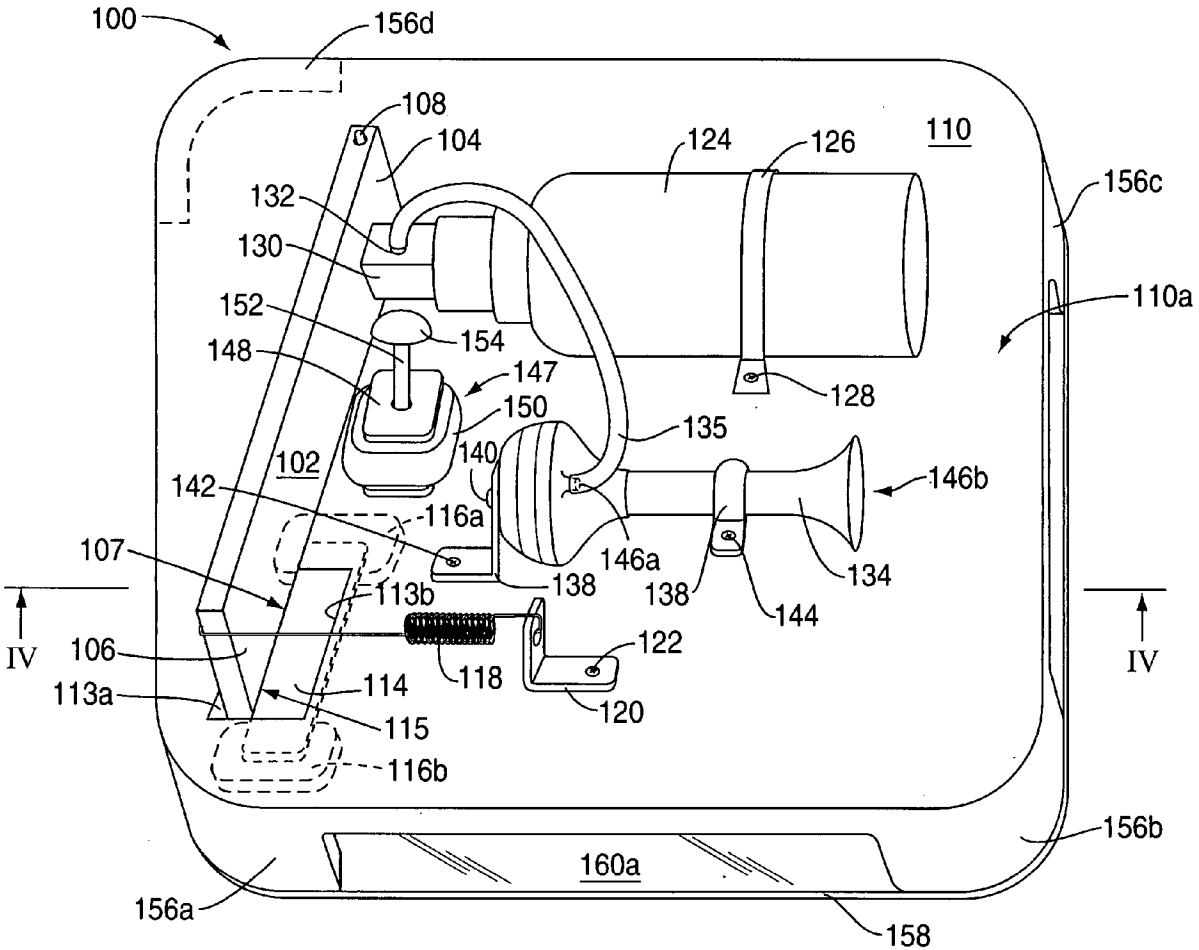
FIG. 1 is a top perspective view of a water sensor in accordance with one embodiment of the present invention.
Figure 2:
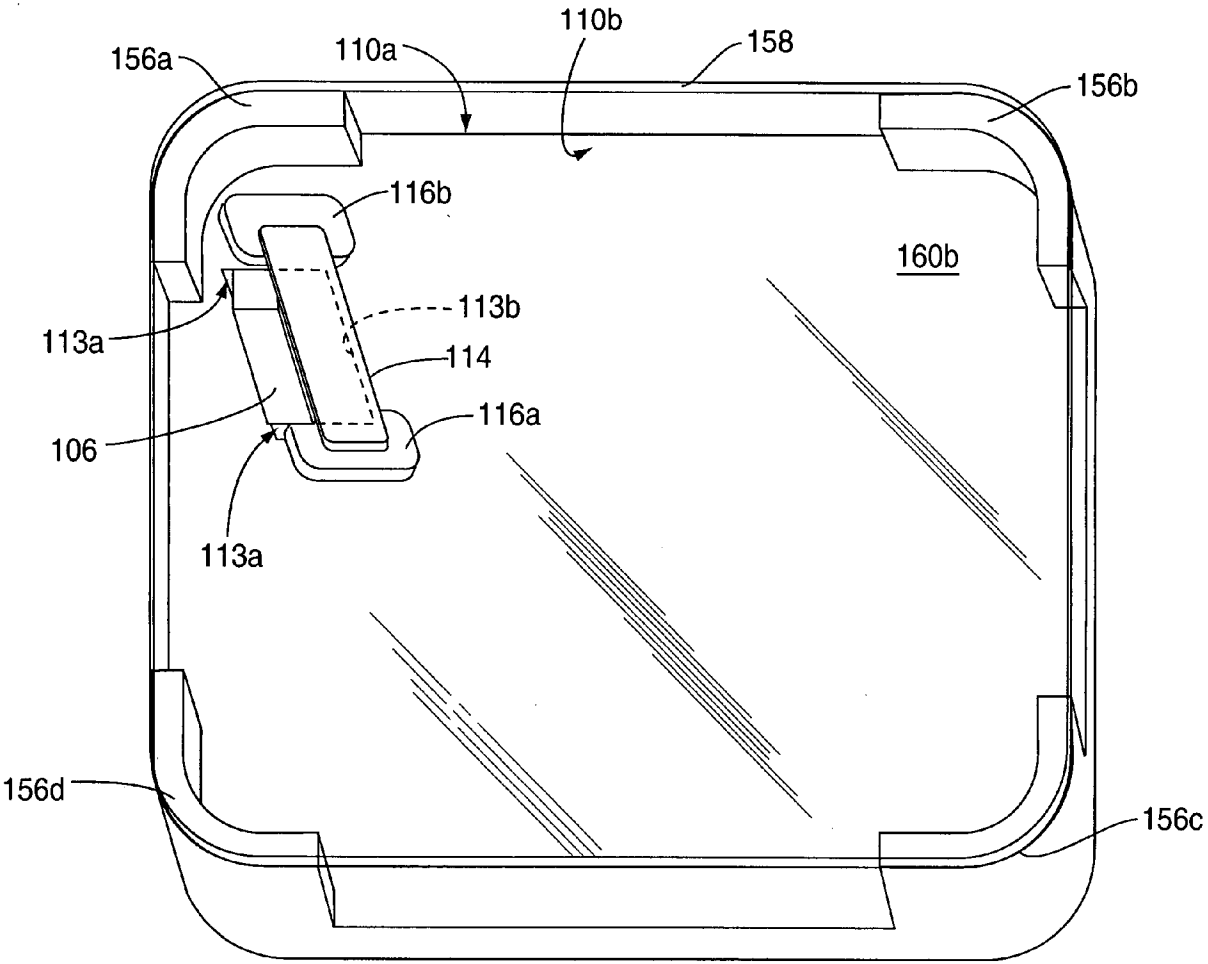
FIG. 2 is a bottom perspective view of the water sensor illustrated in FIG. 1.

Referring to FIGS. 1 and 2, one embodiment of a water sensor 100 is shown in a top perspective view and a bottom perspective view, respectively. As will be discussed in more detail below, the invention contemplates that the water sensor 100 is placed with a shield 158 atop a surface (not shown), such as a floor surface, for example, that is identified for water sensing.

The shield has a top surface 160*a* and a bottom surface 160*b*. In one position, the shield 158 is between the floor surface and a plurality of feet 156*a*, 156*b*, 156*c* and 156*d*. The plurality of feet elevate a base 110 having a top side 110*a* and a bottom side 110*b*, and provide clearance for water or other liquid to flow into the water sensor 100 for detection between the bottom side 110*b* and the shield 158. In such a position, water flowing over the floor surface and otherwise existing proximate the water sensor 100 will flow atop the shield 158 and into contact with a trigger material 114 that is captively held between retaining members, namely a pair of struts 116*a* and 116*b*, (shown in phantom in FIG. 1 and in FIG. 2, a bottom perspective view of FIG. 1). The trigger material 114 is a material that is structurally rigid when substantially dry, and deforms upon contact with a liquid such as water, thereby relinquishing structural rigidity.

When dry and structurally rigid, the trigger material 114 structurally supports a transfer arm 102 being biased into contact therewith by a spring 118, thereby immobilizing the transfer arm. As water leaks, drips, trickles, and otherwise flows atop the floor surface proximate the water sensor 100, the water flows atop the shield 158 and into contact with the trigger material 114. Upon becoming wet from contact with the water, the trigger material 114 deforms, losing rigidity and structural integrity necessary to structurally support the transfer arm 102 against movement from urging of the spring 118.

As the spring 118 urges the transfer arm 102 toward the trigger material 114, which has lost rigidity and structural integrity, the transfer arm 102 moves into and further deforms the trigger material 114, thereby converting potential energy into kinetic energy. The potential energy was being retained when the transfer arm was biased and immobile. The kinetic energy is used to activate a valve 130 of a pneumatic tank 124 that is coupled to an air horn 134, thereby providing an audible alarm that water has been sensed by the water sensor 100. A locking apparatus 147 may structurally support and immobilize the transfer arm 102 against urging of the spring 118 while the trigger material 114 is removed for service, for example.

Described in more detail, the transfer arm 102 has a first end 104 and a second end 106. The transfer arm 102 is pivotally affixed to the base 110 atop the top side 110*a* at the first end 104 about a pin 108. The second end 106 extends from atop the top side 110*a* to protrude through an orifice 112, which may be defined by the base 110 with a rear edge 113*a* and a front edge 113*b*.

The trigger material 114 is shaped to define a straight edge 115 to be flush with the second end 106, though one skilled in the art will recognize that many shapes of trigger may be used, such as angled, peaked or curved, for example (refer to FIGS. 3, 6–7 and 9–10). The pair of struts 116*a* and 116*b* may be located on the bottom side 110*b* and proximate the orifice 112 defined by the base 110, such that the trigger material 114 is captively held therebetween and substantially proximate the orifice 112.

As shown in FIG. 1, the spring 118 is decompressed and connected in a stretched manner between a bracket 120 and the second end 106, thereby to bias the transfer arm 102 toward the trigger material 114 and an "activated state" by urging the transfer arm 102 about the pin 108 and toward the front edge 113*b* of the orifice 112. The activated state will be discussed in more detail below. The straight edge 115 of the trigger material 114 is in substantial contact with the second end 106 of the transfer arm 102 beneath the base 110, thereby to retain the transfer arm 102 in a "deactivated state" away from the front edge 113*b*, against the compression of the spring 118. The deactivated state will be discussed in more detail below.

The bracket 120 is affixed to the base 110 with a screw 122. One skilled in the art will recognize that the bracket 120 could be a molded bracket or mount integral to the base 110 and that the bracket 120 could be affixed to the base 110 with suitable material for affixing, such as glue, injection molding, a bolt, or a nail, for example. The spring 118 may be suitable material for urging, such as a rubber band, a tensioned metal strip, and a resilient material, for example. One skilled in the art will recognize that the transfer arm 102 may be urged toward the trigger material 114 by pulling from in front of the transfer arm 102, as shown in FIG. 1 with the spring 118 decompressed, or by pushing from behind the transfer arm 102 with a resilient material compressed, as discussed in more detail below in FIG. 6.

In one embodiment, the pneumatic tank 124 is fixedly mounted to the base 110 with a bracket 126 and a screw 128, such that the valve 130 may be deactivated by pivoting the transfer arm toward the rear edge 113*a* to engage the deactivated state. The deactivated state may be defined as any position of the transfer arm 102 whereby the valve 130 of the pneumatic tank remains inactivated. In a similar manner, pivoting the transfer arm 102 toward the front edge 113*b* to engage the activated state may activate the valve 130. The activated state may be defined as a position of the transfer arm 102 whereby the valve 130 of the pneumatic tank is activated.

The valve 130 includes an outlet 132 through which air flows from the pneumatic tank upon activation of the valve 130. An air horn 134 is fixedly mounted to the base 110 with brackets 136, 138 and screws 140, 142, and 144. The air horn 134 includes an inlet 146*a* and an outlet 146*b* through which air flows, thereby sounding the air horn 134. A plastic tubing 135 through which air may flow is connected between the outlet 132 and the inlet 146*a*.

FIG. 1 also shows a locking apparatus 147 to prevent the water sensor 100 from activating the air horn 134 when the trigger material 114 is removed for servicing and/or replacement, or in the case the water sensor 100 is desired to not be operational. The locking apparatus 147 includes a bracket 148 fixedly mounted to the base 110, a cam 150 housed by the bracket 148, and an axle 152 and a knob 154 connected to the cam 150. The bracket 148 may be fixedly mounted to the base 110 with suitable material, such as glue, for example. In one embodiment, the cam 150 may be offset and rotatably mounted through the bracket 148, thereby to provide a manner for selectively locking the transfer arm 102, against the urging of the spring 118, in the deactivated state toward the rear edge 113*a* and away from the front edge 113*b*.

FIG. 1 shows the cam 150 in the "unlocked" position rotated away from contact with the transfer arm 102, which arm may be blocked by contact with the trigger material 114 from movement into the activated state toward the front edge 113*b*. One skilled in the art will recognize that the transfer arm 102 may be locked with other locking mechanisms, such as a wedge incorporated on a plunger, a lever operating on a fulcrum (see FIG. 9), and a hinged arm with a wheel that may roll along a groove in the transfer arm 102, for example.

The shield 158 protects the internal components of the water sensor 100 and has the top surface 160*a* affixed to the plurality of feet 156*a*, 156*b*, 156*c* and 156*d*, such that a bottom surface 160*b* may rest substantially flush upon the surface selected for water sensing. In one embodiment, the shield 158 may have the top surface 160*a* removably affixed to the feet 156*a*, 156*b*, 156*c* and 156*d*. A substantially thin material is contemplated for the shield 158, thereby to minimize the lip over which water on the floor surface would have to pass in order to cross over the top surface 160*a*. The shield 158 protects the trigger material 114 from unintended contact with water, such as unintended wicking of trace water from a known spill or non-leaking source, for example.

FIGS. 1 and 2 show the shield 158 as a transparent material, but any material conceivable may be utilized, such as plastic, metal, hardware cloth, and low capillary-action materials, for example. A substantially thin material is contemplated for the shield 158, thereby to minimize the lip over which existing water on the intended water surface would have to pass in order to cross over the top surface 160*a* to contact the trigger material 114. Further, the invention contemplates the trigger material 114 being in contact with the top surface 160*a*, thereby to maximize potential contact with water crossing over the top surface 160*a*. Moreover, the shield 158 may be sloped toward the trigger material 114 from one or more directions, thereby to maximize potential contact with water moving onto the top surface 160*a*.

The present invention may be used on a level surface as well as a sloped surface. One skilled in the art will recognize that the present invention may be used on a sloped surface by channeling water, which may flow on the sloped surface, toward the trigger material 114, thereby to minimize water that may flow down the sloped surface but away from the trigger material 114.

As described above, the trigger material 114 may be a material that is structurally rigid when substantially dry and may deform upon contact with water, relinquishing structural rigidity. In one embodiment, the trigger material 114 may have absorption characteristics that are enhanced by existence of the surface tension of a liquid, such as water, for example. The trigger material 114 may be a compressed sponge, for example. Further, the trigger material 114 may be a material other than a compressed sponge, such as a Trilitera brand sponge, including, but not limited to polyvinylacetate (PVA), inorganic salt, starch, a natural material, and a synthetic material, for example. The trigger material 114 may be a substance that deforms by dissolving or softening when in contact with water, including, but not limited to, a chemical tablet such as an antacid tablet, an aspirin tablet, a starch, sugar, gel, a softgel ingestible pill such as a vitamin pill, PVA, modified PVA, ice and a combination of any of these materials, for example. The trigger material 114 may be comprised of a substrate being either natural or synthetic like gelatin, modified gelatin, PVA, modified PVA, starch, synthetically modified starch, sugar, modified sugar, or compressed foams or sponges, or other materials known to swell, deform, or soften when exposed to the liquid to be detected, such as water for example. Preferably, but not limiting, for the example of water, the trigger material 114 is hydrophilic and softens but does not dissolve when coming into contact with water.

It is contemplated that the trigger material 114 may be a material that may be structurally rigid when dry and may deform upon contact with liquids other than water, such as gasoline, oil, acid, bleach and ammonia, for example.

Figure 3:
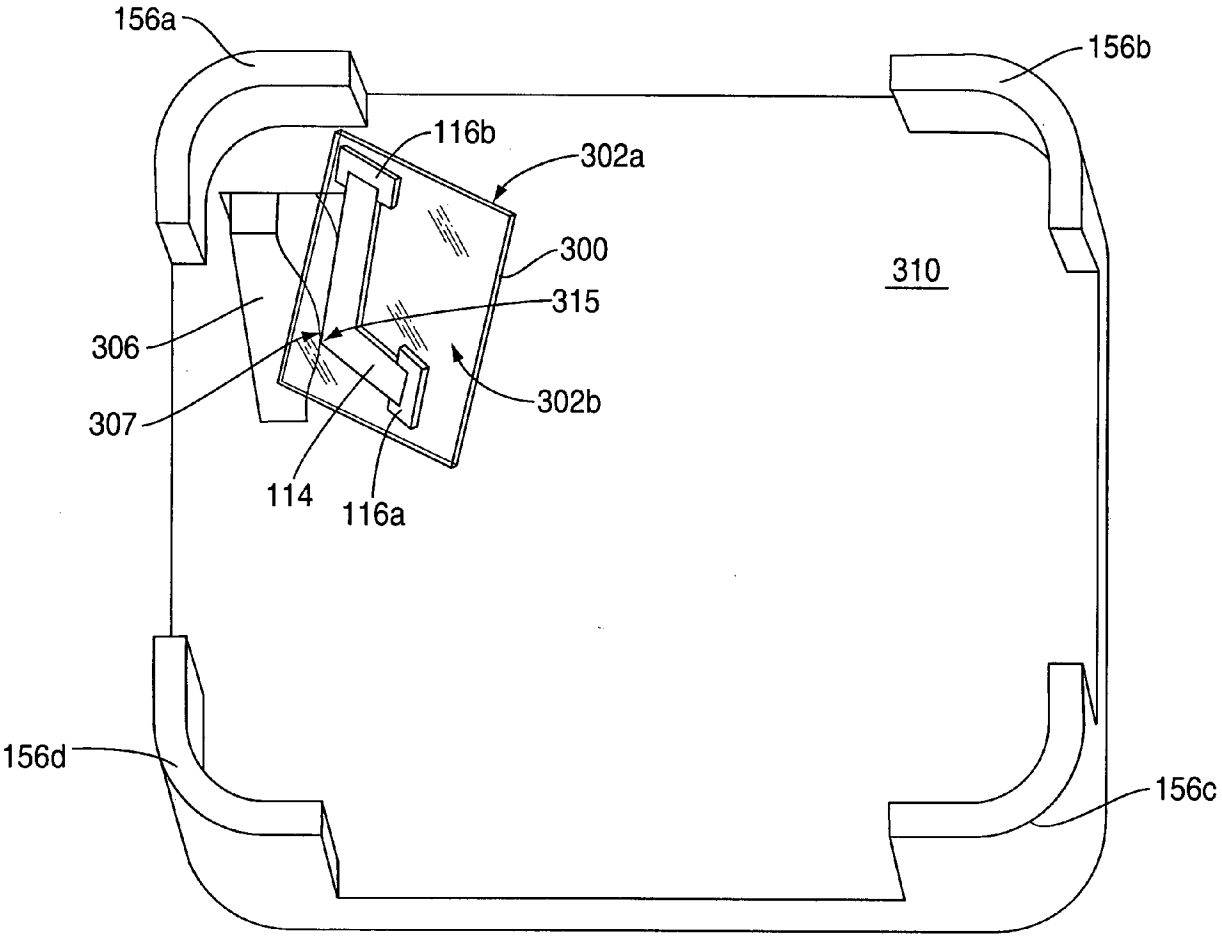
FIG. 3 is a bottom perspective view of the water sensor in accordance with an alternative embodiment of the present invention.

As shown in FIG. 3, one embodiment of the present invention utilizes a shield 300 that covers a smaller area than the area defined by the plurality of feet 156*a*, 156*b*, 156*c* and 156*d*. One skilled in the art will recognize that the shield 300 need not cover the entire surface area of the base 310 and may only cover the surface area of the trigger material 114 in order to sufficiently protect the trigger material 114 from unintended contact with water, such as unintended wicking of trace water from a known spill or non-leaking source, as described for the shield 158 in FIG. 2 above. Similarly, a substantially thin material is contemplated for the shield 300, thereby to minimize the lip over which water on the floor surface would have to pass in order to contact the trigger material 114.

The shield 300 may be affixed to the trigger material 114 with glue or other fastener means, for example. The shield 300 may be affixed to the struts 116*a* and 116*b* with glue or other fastener means, for example. In one embodiment, with the plurality of feet atop and in contact with the intended surface over which water is to be detected, a top surface 302*a* of the shield 300 is in contact with the trigger material 114 and the bottom surface 302*b* of the shield 300 may be atop and in contact with the intended surface over which water is to be detected. In one embodiment, the shield 300 may be applied directly to the trigger material 114, including applications such as paint and spray, for example.

Moreover, FIG. 3 shows one embodiment of the transfer arm 102 having a second end 306 that is angled to define a peaked edge 307 that is in contact with a peaked edge 315 defined by the trigger material 114. The contact of the peaked edge 307 with the peaked edge 315 minimizes the contact area of the trigger material 114 that must become sufficiently wet before the structural support of the trigger material 114 is relinquished sufficiently for the transfer arm 102 to move, as described in more detail in FIG. 1. Providing a peaked edge 315 may aid in detection of water since a smaller portion of the trigger material 114 and thereby less force is holding the transfer arm 102 in place. This design may improve the sensitivity of the water sensor 100 in that less water is required to come in contact with the trigger material 114 to deform.

Figure 4:
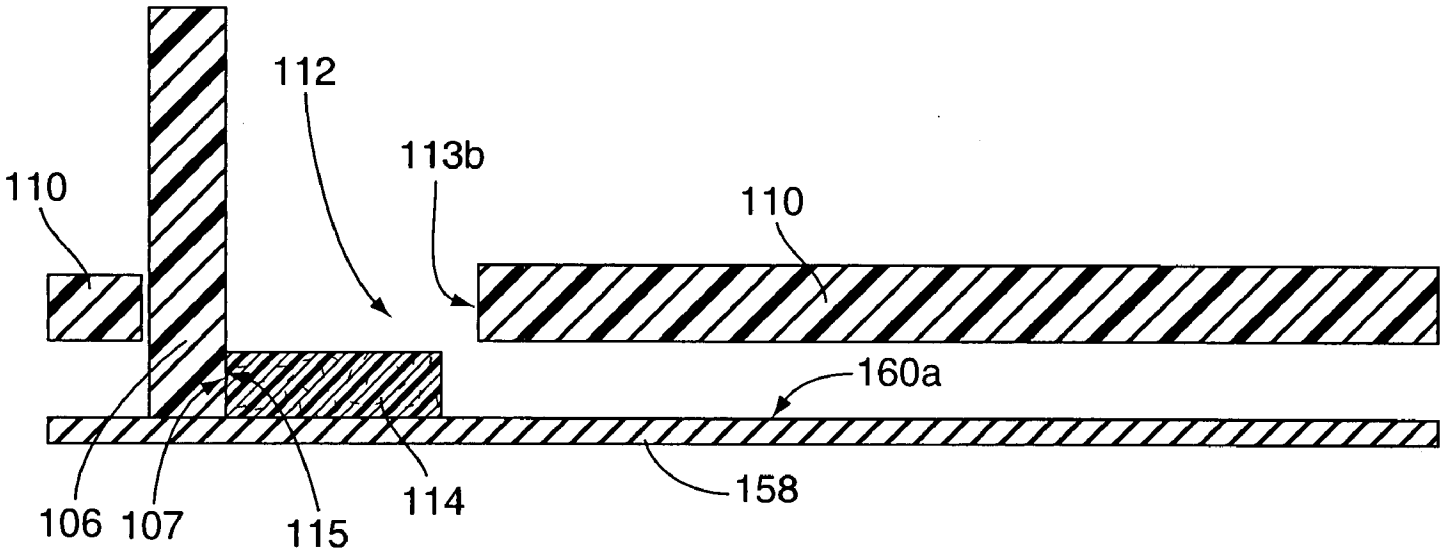
FIG. 4 is a cross-sectional view of the embodiment illustrated in FIG. 1, as taken along lines IV—IV of FIG. 1 and viewed in the direction of the arrows.

FIG. 4 shows a cross-sectional view of the embodiment of FIG. 1, as taken along lines IV—IV of FIG. 1 and viewed in the direction of the arrows. The trigger material 114 is adjacent and substantially flush with the second end 106 of the transfer arm 102 (not shown), and beneath the orifice 112 defined by the base 110. The straight edge 107 of the second end 106 is in substantial contact with the straight edge 115 of the trigger material 114 as the trigger material 114 retains the second end 106 in the deactivated state away from the front edge 113*b*, against urging of the spring 118 (FIG. 1). The top surface 160*a* of the shield 158 may be in contact with the trigger material 114.

Figure 5:
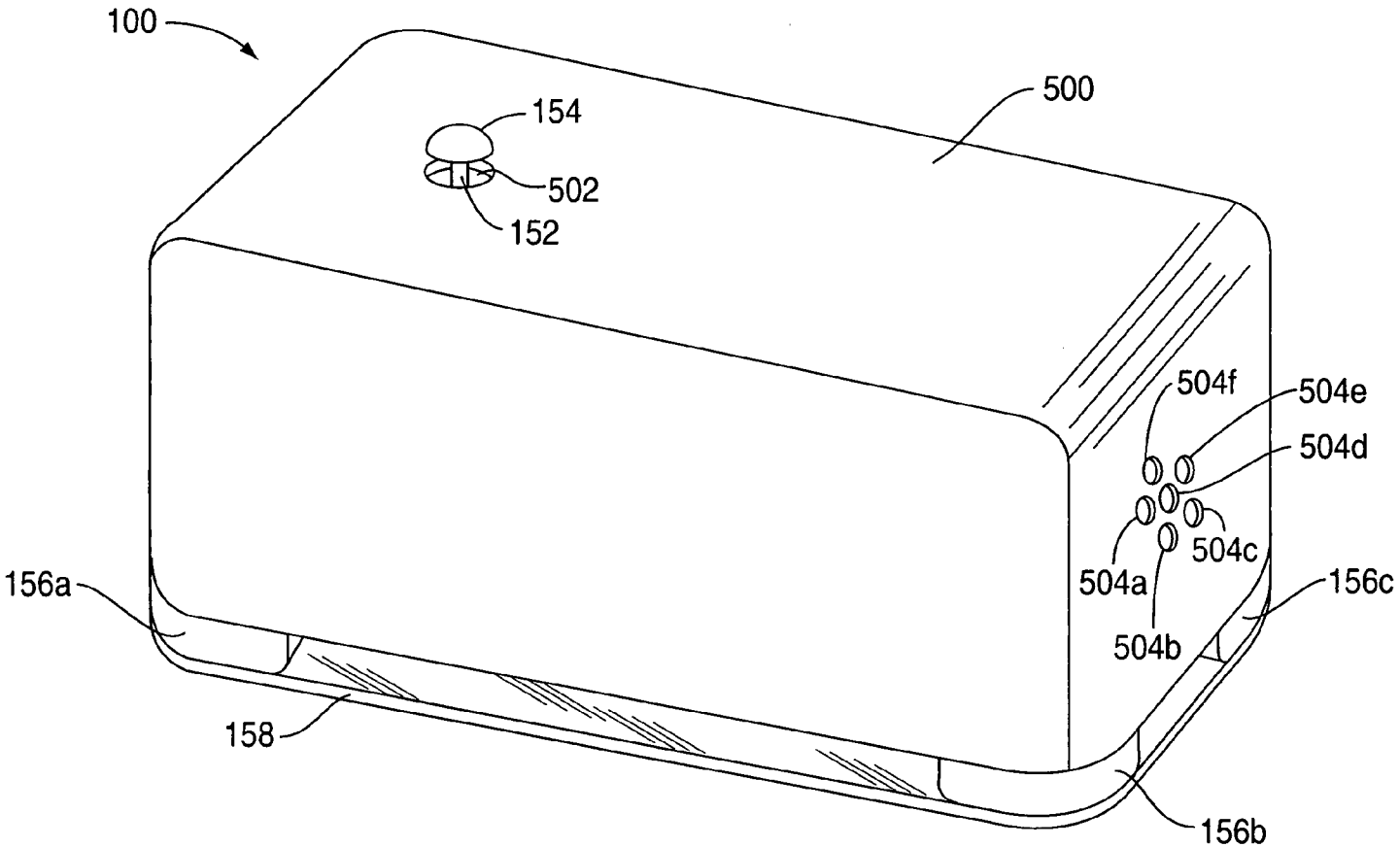
FIG. 5 is a top perspective view showing a cover that can be installed atop the water sensor in accordance with any embodiment of the present invention.

FIG. 5 is a top perspective view showing a cover 500 installed over the base 110 of the water sensor 100 in accordance with one embodiment of the present invention to provide a protective housing for the water sensor 100. The cover 500 may define an orifice 502 through which the axle 152 and the knob 154 may extend for manual rotational adjustment of the knob 154 and the offset cam 150 with the cover 500 installed. The cam 150 may be adjusted manually with the cover 500 installed. As is well known in the art, the cam 150 may be adjusted in other manners, including automatically and by remote control, for example. Proximate to the outlet 146*b* of the air horn 134 shown in FIG. 1, the cover 500 of FIG. 5 may define a plurality of orifices 504*a*, 504*b*, 504*c*, 504*d*, 504*e*, and 504*f*, through which air horn sound may be transmitted.

Figure 6:
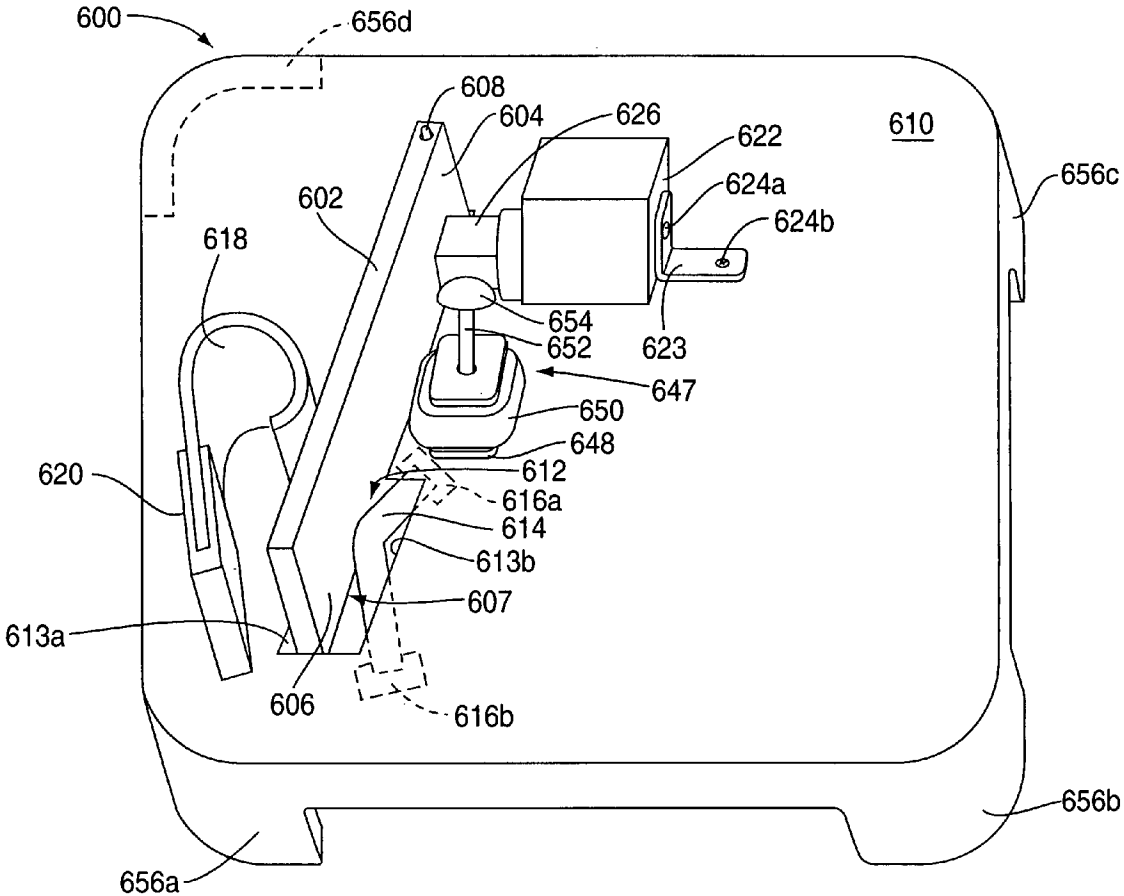
FIG. 6 is a top perspective view of the water sensor in accordance with another embodiment of the present invention.

Referring to FIG. 6, another embodiment of a water sensor 600 is shown in a top perspective view. In this embodiment, a different spring 618 is used to provide potential energy in the transfer arm 602 to detect water when water comes into contact with the trigger 614. A transfer arm 602, having a first end 604 and a second end 606, is pivotally affixed at the first end 604 about a pin 608 to a base 610. The second end 606 extends to protrude through an orifice 612, which is defined by the base 110 with a rear edge 613*a* and a front edge 613*b*. Similar to FIG. 1, the second end 606 may be shaped to define a straight edge 607, instead of the peaked edge shown in FIG. 3. The second end 606 of the present invention is not limited to a particular edge, and any conceivably shaped edge may be utilized, including a peaked edge or a curved edge, for example.

A trigger 614 is captively held between a pair of struts 616*a*, 616*b*, (shown in phantom in FIG. 6) beneath the orifice 112, in the manner described in FIGS. 1 and 2 hereinabove. An embodiment of the trigger 614 may be shaped and of a material as described in FIGS. 1 and 2 hereinabove.

In the embodiment shown in FIG. 6, a spring 618 is compressed and affixed to the base 610 in a bracket 620, such that the spring 618 pushes against the transfer arm 602, thereby to bias the transfer arm 602 into contact with the trigger 614 by urging the transfer arm 602 about the pin 608 and toward the front edge 613*b* of the orifice 612. An embodiment of the spring 618 may be a strip of resilient material, such as metal or plastic, for example. The trigger material 114 captively held between the pair of struts 116*a*, 116*b* beneath the base 110 is in contact with the straight edge 107 of the transfer arm 102, thereby to retain the transfer arm 602 away from the front edge 613*b* against the decompression urging of the spring 618. One skilled in the art will recognize that the bracket 620 may be a molded bracket or mount integral to the base 610. Moreover, the bracket 620 may be affixed to the base 610 with means suitable for affixing, such as glue, injection molding, a bolt, or a nail, for example.

A signaling apparatus 622 may be affixed to the base 610 with a bracket 623 and screws 624*a*, 624*b*. One skilled in the art will recognize that the bracket 623 may be a molded bracket or mount integral to the base 610 and that the bracket 623 may be affixed to the base 610 with suitable material for affixing, such as glue, injection molding, a bolt, a nail, or other fastener, for example. The signaling apparatus 622 may include an activation switch 626. Movement of the transfer arm 602 toward the front edge 613*b* may activate the activation switch 626 to provide a signal, including but not limited to, an audible signal, a visible signal, electrical energy, optical energy, and a computer instruction. One skilled in the art will understand that the signaling apparatus 622 may include, but is not limited to, apparatus such as an audible alarm, a visible alarm, a relay electrically coupled to an alarm, a solenoid electrically coupled to an alarm, and a computer system.

FIG. 6 also shows a locking apparatus 647 including a bracket 648 fixedly mounted to the base 610 with glue, for example, a cam 650 housed by the bracket 648, and an axle 652 and a knob 654 connected to the offset cam 650. In one embodiment, the cam 150 may be offset and rotatably mounted through the bracket 648, thereby providing for selectively locking of the transfer arm 602, against the urging of the spring 618, in the deactivated state toward the rear edge 613*a* and away from the front edge 613*b*. FIG. 6 shows the cam 650 in the "locked" position, rotated to contact and block the transfer arm 602 from movement toward the front edge 113*b*. When in the locked position, unintentional activation of the signaling apparatus 622 is minimized while the trigger 614 may be serviced, for example.

FIG. 6 also shows the base 610 with a plurality of feet 656*a*, 656*b*, 656*c* and 656*d* (shown in phantom), thereby to elevate the base 610 and provide clearance beneath the base 610 for the transfer arm 602 protruding therethrough, the trigger 614, and the struts 616*a* and 616*b*, as described in more detail above in FIG. 2.

Figure 7:
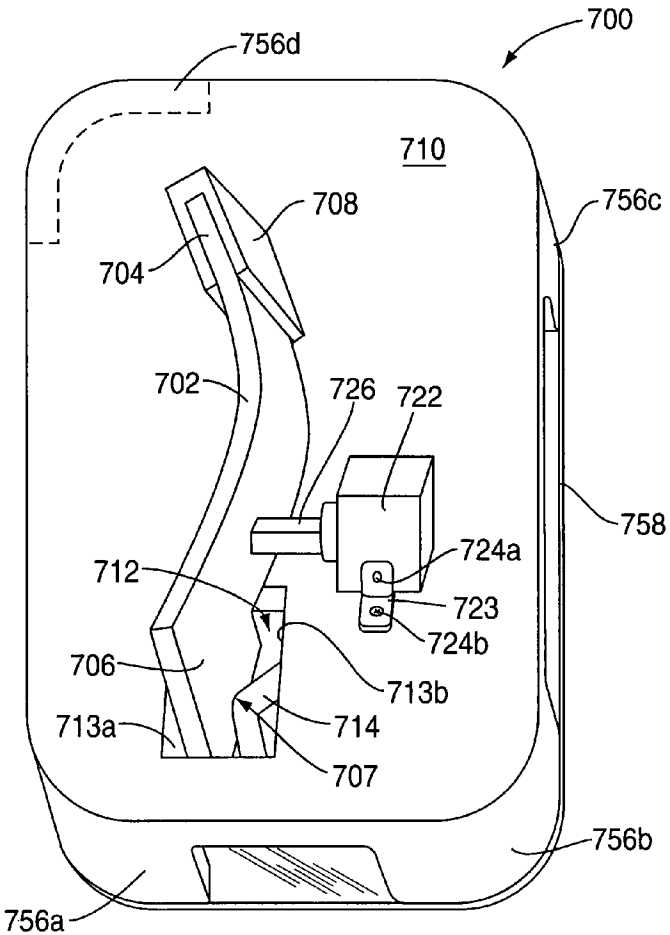
FIG. 7 is a top perspective view of the water sensor illustrated in FIG. 6.

FIG. 7 shows a top perspective view of a water sensor 700 in accordance with another embodiment of the present invention. A transfer arm 702, having a first end 704 and a second end 706, may be manufactured of a resilient material, such as, but not limited to, a strip of metal, for example. The second end 706 extends to protrude through an orifice 712, which is defined by the base 710 with a rear edge 713*a* and a front edge 713*b*. The transfer arm 702 is shown affixed under tension to the base 710 with a bracket 708, such that the transfer arm 702 is compressed and biases the second end 706 toward a trigger 714 by urging the second end 706 toward the front edge 713*b* of the orifice 712.

The trigger 714 is captively held beneath the orifice 112, in the manner described in FIGS. 1 and 2 hereinabove. The trigger 714 is shown shaped with a peaked edge 707, similar to that described in FIG. 3, and made of a material as described in FIGS. 1 and 2. The trigger 714 contacts the second end 706 of the transfer arm 702, thereby to retain the transfer arm 702 away from the front edge 713*b*, against the decompression urging of the transfer arm 702. One skilled in the art will recognize that the bracket 720 may be a molded bracket or mount integral to the base 710 and that the bracket 720 may be affixed to the base 710 with suitable material, such as glue, injection molding, a bolt, or a nail, for example.

The signaling apparatus 722 may be affixed to the base 710 with a bracket 723 and screws 724*a*, 724*b*, similar to the description in FIG. 6 above. The signaling apparatus 722 may include an activation switch 726. Movement of the transfer arm 702 toward the front edge 713*b* may activate the activation switch 726 in the manner described in FIG. 6 hereinabove. In the embodiment shown, the base 710 has a plurality of feet 756*a*, 756*b*, 756*c* and 756*d* (shown in phantom), thereby to elevate the base 710 and provide clearance beneath the base 710 for the transfer arm 702, and the trigger 714 in the manner described in detail in FIGS. 1 & 2 hereinabove. FIG. 7 shows a shield 758 affixed in the manner described in detail in FIGS. 1 & 2 hereinabove.

Figure 8:
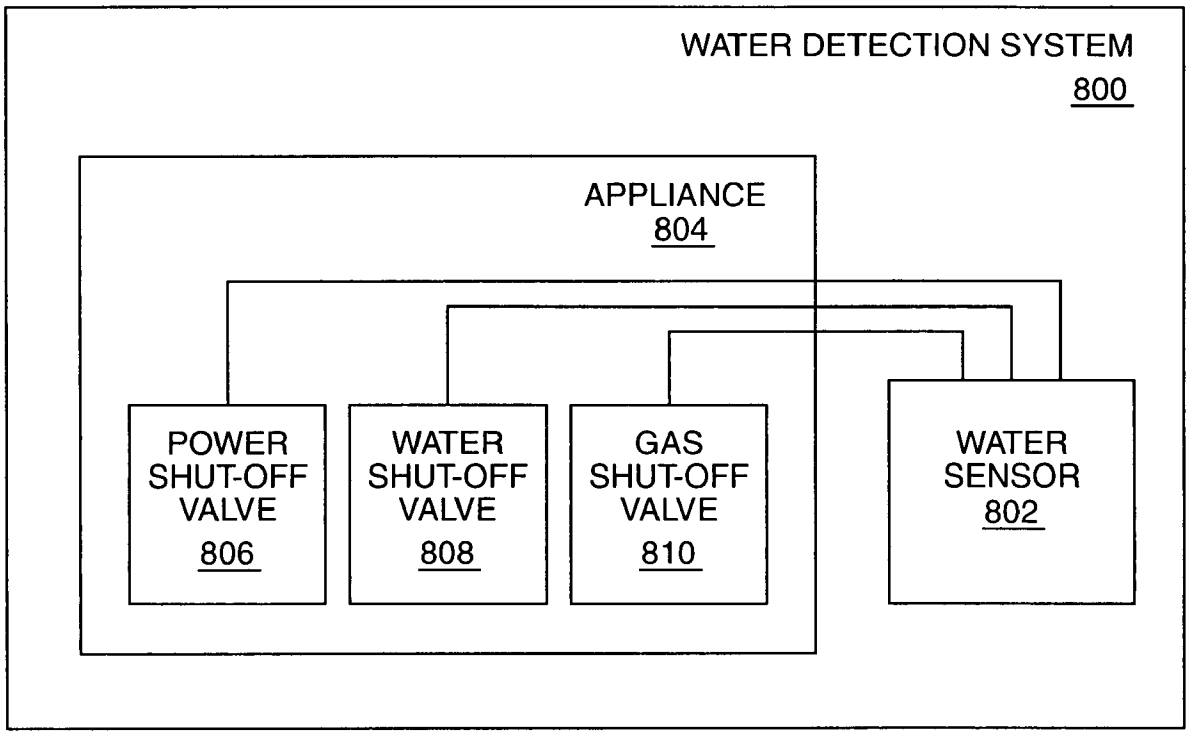
FIG. 8 is a block diagram of a water detection system with a preferred embodiment of the water sensor operably connected to valves of an appliance, in accordance with the present invention.

FIG. 8 is a block operational diagram of a water detection system 800 with one embodiment of a water sensor 802 operably connected to an appliance 804. In one embodiment, the appliance 804 may be equipped with a power shut-off valve 806, which is operably connected to the water sensor 802, thereby to suspend a supply of electrical power proximate the appliance 804 when water is sensed in the manner described hereinabove. In another embodiment, the appliance 804 may be water-based and equipped with a water shut-off valve 808, which is operably connected to the water sensor 802, thereby to suspend a supply of water proximate the appliance 804 when water is sensed in the manner described hereinabove. In another embodiment, the appliance 804 may be equipped with a gas shut-off valve 810, which is operably connected to the water sensor 802, thereby to suspend a supply of flammable gas proximate the appliance 804 when water is sensed in the manner described hereinabove. One skilled in the art will recognize that the appliance 804 may be equipped with other connections that may be operably connected to the water sensor 802. The water sensor 802 may be connected to the appliance 804 with connections, including but not limited to, electrical, mechanical and optical.

Figure 9:
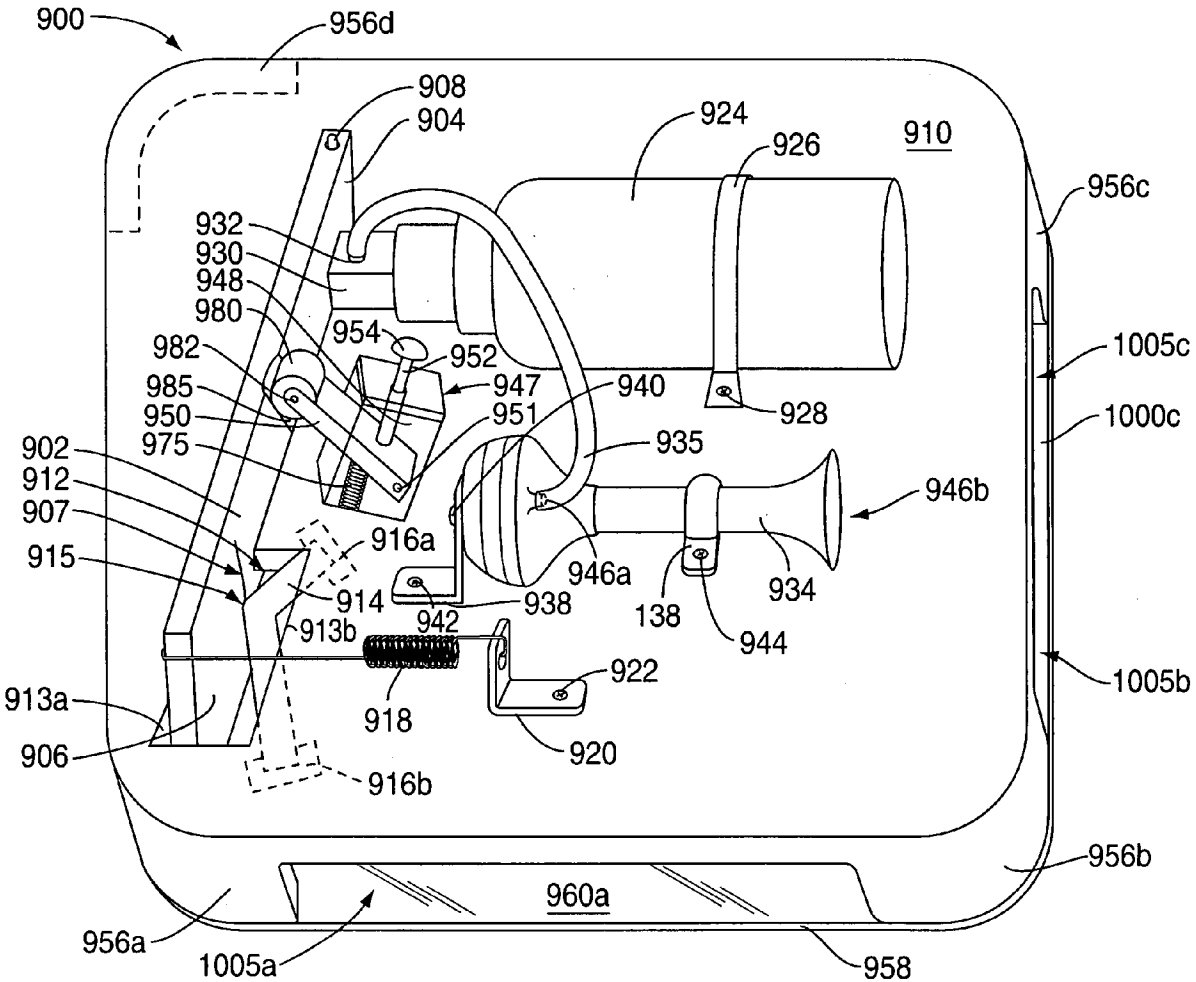
FIG. 9 is a top perspective view of a water sensor in accordance with another embodiment of the present invention.
Figure 10:
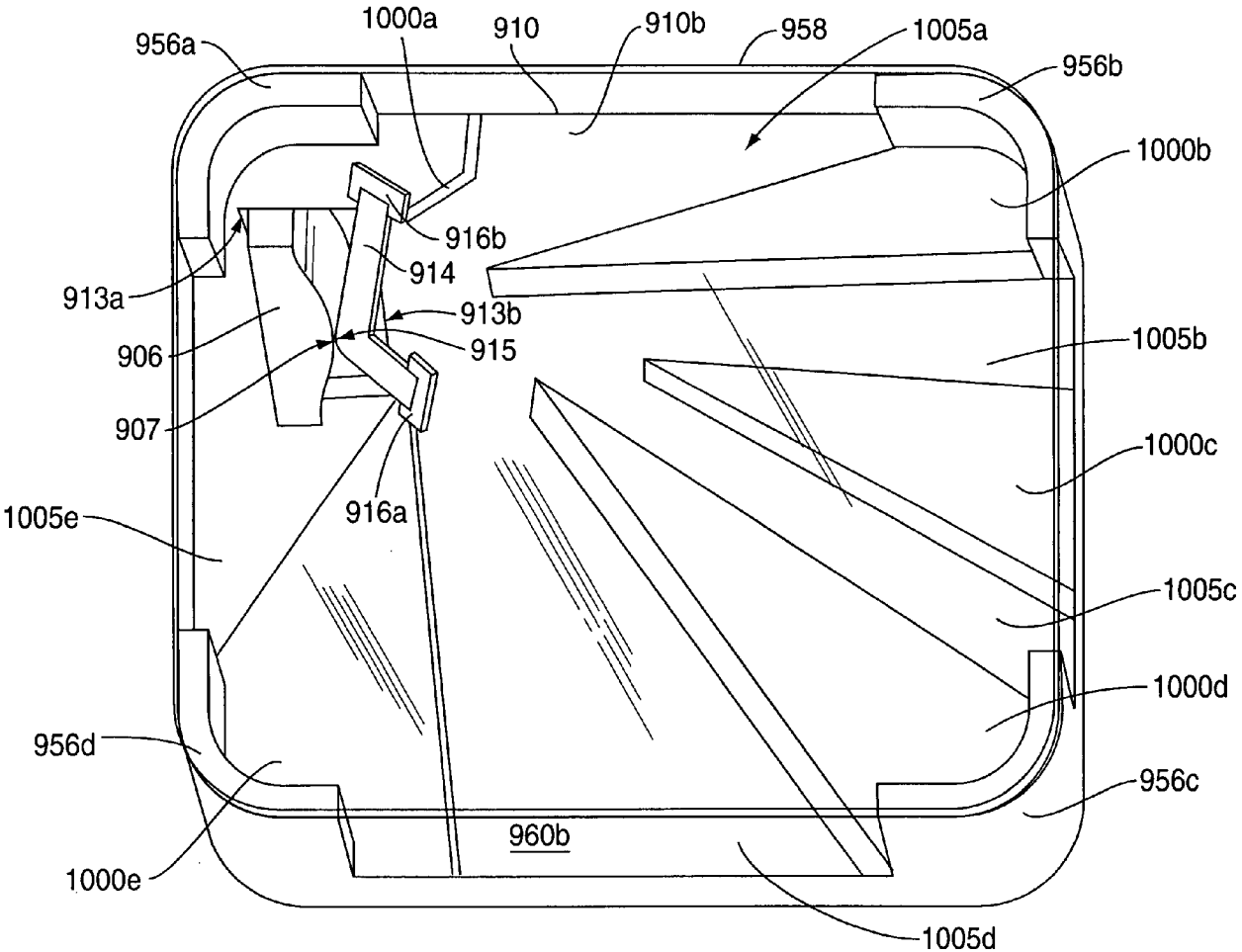
FIG. 10 is a bottom perspective view of the water sensor in accordance with a preferred embodiment of the present invention.

Referring to FIGS. 9 and 10, another embodiment of a water sensor 900 is shown in a top perspective view and a bottom perspective view, respectively. A transfer arm 902, having a first end 904 and a second end 906, is pivotally affixed at the first end 904 about a pin 908 to a base 910. The second end 906 extends to protrude through an orifice 912, which may be defined by the base 910 with a rear edge 913*a* and a front edge 913*b*. As better viewed in FIG. 10, which is a bottom perspective view of the embodiment shown in FIG. 9, the second end 906 is shaped to define a peaked edge 907. The second end 906 of the present invention is not limited to a particular edge, and any conceivably shaped edge may be utilized, including a straight edge or a curved edge, for example.

A trigger 914 is captively held between a pair of struts 916*a*, 916*b*, (shown in FIG. 2 and in phantom in FIG. 1) located beneath the base 910 and proximate the orifice 912. The trigger 914 is shaped to define a peaked edge 915, similar to the description in FIG. 3, though one skilled in the art will recognize that many shapes of trigger may be used, such as straight or curved, for example. The trigger 914 is a material similar to the description in FIG. 1, hereinabove.

A spring 918 may be decompressed and connected in a stretched manner between a bracket 920 and the second end 906, thereby to bias the transfer arm 902 toward the "activated state" by urging the transfer arm 902 about the pin 908 and toward the front edge 913*b* of the orifice 912. The activated state was discussed in more detail in FIG. 1, above. The peaked edge 915 of the trigger 914 is in contact with the peaked edge 907 of the transfer arm 902 beneath the base 910, thereby to retain the transfer arm 902 in a "deactivated state" away from the front edge 913*b*, against the compression of the spring 918. The deactivated state was discussed in more detail in FIG. 1, above.

The bracket 920 is affixed to the base 910 with a screw 922. One skilled in the art will recognize that the bracket 920 could be a molded bracket or mount integral to the base 910 and that the bracket 920 could be affixed to the base 910 with suitable material for affixing, such as glue, injection molding, a bolt, or a nail, for example. The spring 918 may be suitable material for urging, such as a rubber band, a tensioned metal strip, and a resilient material, for example.

One skilled in the art will recognize that the transfer arm 902 may be urged toward the trigger 914 by pulling from in front of the transfer arm 902, as shown in FIG. 9 with the spring 918 decompressed, or by pushing from behind the transfer arm 902 with a resilient material compressed, as discussed in more detail above in FIGS. 6 and 7.

In FIG. 9, a pneumatic tank 924 is fixedly mounted to the base 910 with a bracket 926 and a screw 928, such that a valve 930 may be deactivated by pivoting the transfer arm 902 toward the rear edge 913*a* to engage the deactivated state and the valve 930 may be activated by pivoting the transfer arm 902 toward the front edge 913*b* to engage the activated state.

The valve 930 includes an outlet 932 through which air may flow from the pneumatic tank upon activation of the valve 930. An air horn 934 is fixedly mounted to the base 910 with brackets 936, 938 and screws 940, 942, and 944. The air horn 934 includes an inlet 946*a* and an outlet 946*b* through which air may flow, thereby sounding the air horn 934. A plastic tubing 935 through which air may flow is connected between the outlet 932 and the inlet 946*a*.

FIG. 9 also shows a locking apparatus 947 including a bracket 948 fixedly mounted to the base 910, a lever 950 housed by the bracket 948 and pivotally mounted to the bracket 948 with a pin 951, a spring 975, a wheel 980 rotatably mounted to the lever 950 with an axle 982, and an handle 952 with a knob 954 connected to the lever 9±50. The bracket 948 is shown as a transparent plastic, but any material conceivable may be utilized, such as metal, for example. The bracket 948 may be fixedly mounted to the base 910 with suitable material for affixing, such as glue or other fastener, for example.

In the embodiment shown, a groove 985 is defined by the transfer arm 902 proximate to the wheel 980, thereby to guide the wheel 980 while rolling within the groove 985. The groove 985 may be slanted by being cut deeper at one end of the groove than the other end. The lever 950 may be positioned in the "unlocked" position, with the lever 950 raised and the wheel 980 out of contact with the transfer arm 902, by pulling on the handle 952 with the knob 954. Additionally, the lever 950 may be positioned in the "locked" position, with the lever 950 lowered and the wheel 980 in contact with the transfer arm 902 by pushing on the handle 952 with the knob 954. The spring 975 biases the lever 950 downward and helps the locking apparatus 947 to "snap" into the locked position. The locking apparatus 947 provides a manner for selectively locking the transfer arm 902, against the urging of the spring 918, in the deactivated state toward the rear edge 913*a* and away from the front edge 913*b*. One skilled in the art will recognize that the transfer arm 902 may be locked with other locking apparatus, such as the cam 150 described in FIG. 1, a wedge incorporated on a plunger, and a lever operating on a fulcrum, for example.

In the embodiments shown in FIGS. 9 and 10, the base 910 has a plurality of feet 956*a*, 956*b*, 956*c* and 956*d* (shown in FIG. 10 and in phantom in FIG. 9), thereby to elevate the base 910 and provide clearance beneath the base 910 for the transfer arm 902, the trigger 914, and the struts 916*a* and 916*b*. A shield 958 has a top surface 160*a* removably affixed to the feet 956*a*, 956*b*, 956*c* and 956*d*, thereby to shield the trigger 914 from unintended contact with water, such as unintended wicking of trace water from a known spill or non-leaking source, for example. A bottom surface 960*b* of the shield 958 may rest on an intended surface (not shown) over which water is to be detected. Water may move onto the top surface 960*a* and contact the trigger 914, causing the trigger 914 to deform and relinquish structural rigidity, wherein the transfer arm 902 may be urged through the deformed trigger 914 toward the front edge 913*b* of the orifice 912, thereby to engage the activated state. The shield 958 is shown as a transparent material, but any material conceivable may be utilized, such as plastic, metal, hardware cloth, and low capillary-action materials, for example.

Moreover, FIG. 10, which is a bottom perspective of the embodiment shown in FIG. 9, shows a plurality of guides 1000*a*, 1000*b*, 1000*c*, 1000*d* and 1000*e* that define a plurality of channels 1005*a*, 1005*b*, 1005*c*, 1005*d* and 1005*e*. Water may flow atop the top surface 960*a* (see FIG. 9) of the shield 958 through the channels 1005*a*, 1005*b*, 1005*c*, 1005*d* and 1005*e*, thereby to be directed toward the trigger 914. FIG. 10 shows guides 1000*a*, 1000*b*, 1000*c*, 1000*d* and 1000*e* are affixed to the bottom side 910*b* of the base 910 with glue, for example. One skilled in the art will recognize that the plurality guides may be affixed to the base 910 or to the shield 958 with appropriate means, including molding the plurality of guides to be integral with the base 910 or the shield 958, for example. Moreover, various designs may be formed with more or less guides than the plurality of guides represented in FIG. 10, with the understanding that the guides are intended for defining channels through which water may be directed toward the trigger 914.

Figure 11:
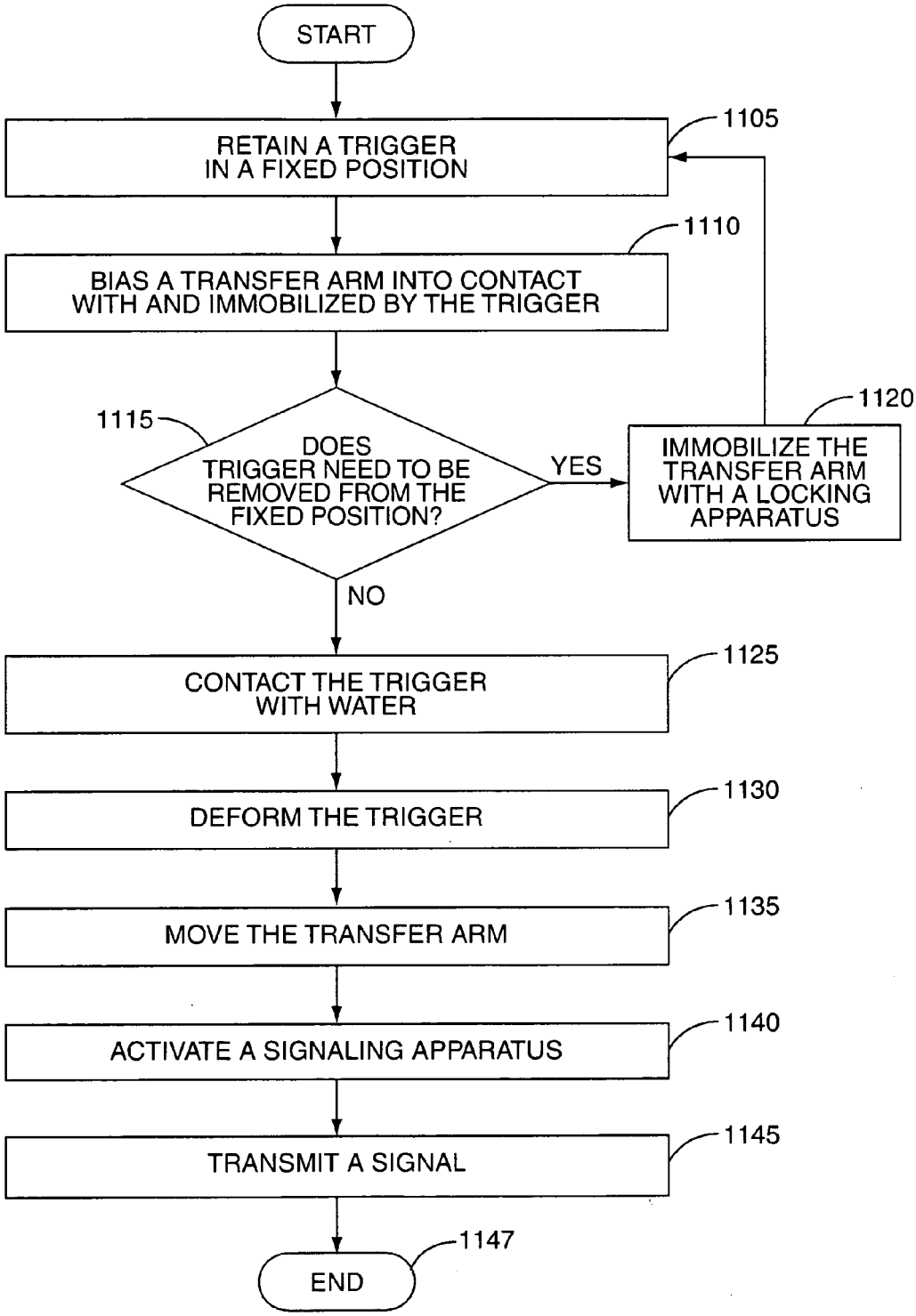
FIG. 11 is a flow chart showing a method of sensing water in accordance with a preferred embodiment of the present invention.

FIG. 11 is a flow chart showing a method of sensing water in accordance with an embodiment of the present invention. The flowchart in FIG. 11 applies to each of the embodiments shown in FIGS. 1–11. Some similarly named parts are labeled with different part numbers that relate to a particular figure; such different part numbers are specified below for clarity.

As shown in block 1105, a trigger material 114, 614, 714, 914 is retained in a fixed position. Block 1110 shows that a transfer arm 102, 602, 702, 902 is biased into contact with the trigger material 114, 614, 714, 914, such that the trigger material 114, 614, 714, 914 immobilizes the transfer arm 102, 602, 702, 902 by blocking further movement of the transfer arm 102, 602, 702, 902 being biased. In this manner, potential energy is retained. Block 1115 shows that if the trigger material 114, 614, 714, 914 must be removed from the fixed position, such as for servicing, particularly while the transfer arm 102, 602, 702, 902 is being biased into contact with and immobilized by the trigger material 114, 614, 714, 914, the transfer arm 102, 602, 702, 902 may be immobilized by "locking" the locking apparatus 147, 647, 947, as shown in block 1120. From block 1120, the trigger material 114, 614, 714, 914 is retained in the fixed position in block 1105, and the locking apparatus 147, 647, 947 is "unlocked", once again to immobilize the transfer arm 102, 602, 702, 902 by the trigger material 114, 614, 714, 914 in block 1110. Additionally, block 1115 shows that if the trigger material 114, 614, 714, 914 need not be removed from the fixed position, then block 1125 shows that the trigger material 114, 614, 714, 914 is contacted with water. Upon contact with water, block 1130 shows that the trigger material 114, 614, 714, 914 deforms, such that structural integrity is lost and the trigger material 114, 614, 714, 914 no longer supports the biased transfer arm 102, 602, 702, 902 in an immobilized position. Block 1135 shows that the transfer arm 102, 602, 702, 902 moves. Movement of the transfer arm 102, 602, 702, 902 results from a conversion of the potential energy to kinetic energy, which kinetic energy is used to activate the pneumatic tank 124, 924 (FIGS. 1 and 9) and the signaling apparatus 622, 722 (FIGS. 6 and 7), as shown by block 1140. Upon activation of the pneumatic tank 124, 924 (FIGS. 1 and 9) and the signaling apparatus 622, 722 (FIGS. 6 and 7), block 1145 shows that a signal is transmitted, thereby signaling that water has been sensed, and the process ends (block 1147).

In operation, the present invention depends on the structural deformation of a trigger in contact with a liquid, such as water, to trigger a mechanical response, such as activating an audible alarm. Moreover, the mechanical response may then trigger an electrical response, such as activating an electrical switch coupled to a solenoid, which then may close a valve to natural gas being distributed to a gas-heated hot water tank, for example.

Using FIGS. 1 & 2 as an example, the transfer arm 102 is retained in a deactivated state, against urging of the spring 118, by the trigger material 114 that may remain structurally rigid while substantially dry, and may be substantially deformed upon water contact, thereby relinquishing structural rigidity. The cam 150 may be rotated to contact the transfer arm 102 and retain the transfer arm 102 in the deactivated state, thereby locking the transfer arm 102 in the disengaged state whether or not the trigger material 114 is captively held between the pair of struts 116*a*, 116*b* beneath the base 110. The offset cam 150 may be used to prevent activation of the valve 130 while the trigger material 114 may be serviced, for example. The offset cam 150 may be rotated out of contact with the transfer arm 102, thereby unlocking the transfer arm 102, such that the transfer arm 102 may be retained in the deactivated state by the trigger material 114 when substantially dry and in contact with the transfer arm 102, while being captively held between the pair of struts 116*a*, 116*b* located beneath the base 110.

Upon contact with water, the trigger material 114 substantially deforms and relinquishes structural rigidity, such that potential energy retained by the spring 118 may converted into kinetic energy through movement of the transfer arm 102 from the deactivated state to an activated state as the transfer arm 102 is urged through the trigger material 114. In the activated state, kinetic energy transferred through movement of the transfer arm 114 may activate the valve 130 of the pneumatic tank 124, thereby audibly sounding the air horn 134 in a manner well known in the art. The pneumatic tank 124 is not subject to an external power source and may be ready to be activated as long as the tank holds air ready to be released.

Referring to FIGS. 6 & 8, in the activated state, kinetic energy transferred through movement of the transfer arm 114 may activate the signaling apparatus 622 of FIG. 6 to provide a plurality of signals to close the power shut-off valve 806, the water shut-off valve 808, and the gas shut-off valve 810. One skilled in the art will recognize that the plurality of signals may provide for automatic as well as manual shut-off and may include, but not be limited to, an electrical signal, an audible signal, a visible signal, and a computer instruction, for example.

Figure 12:
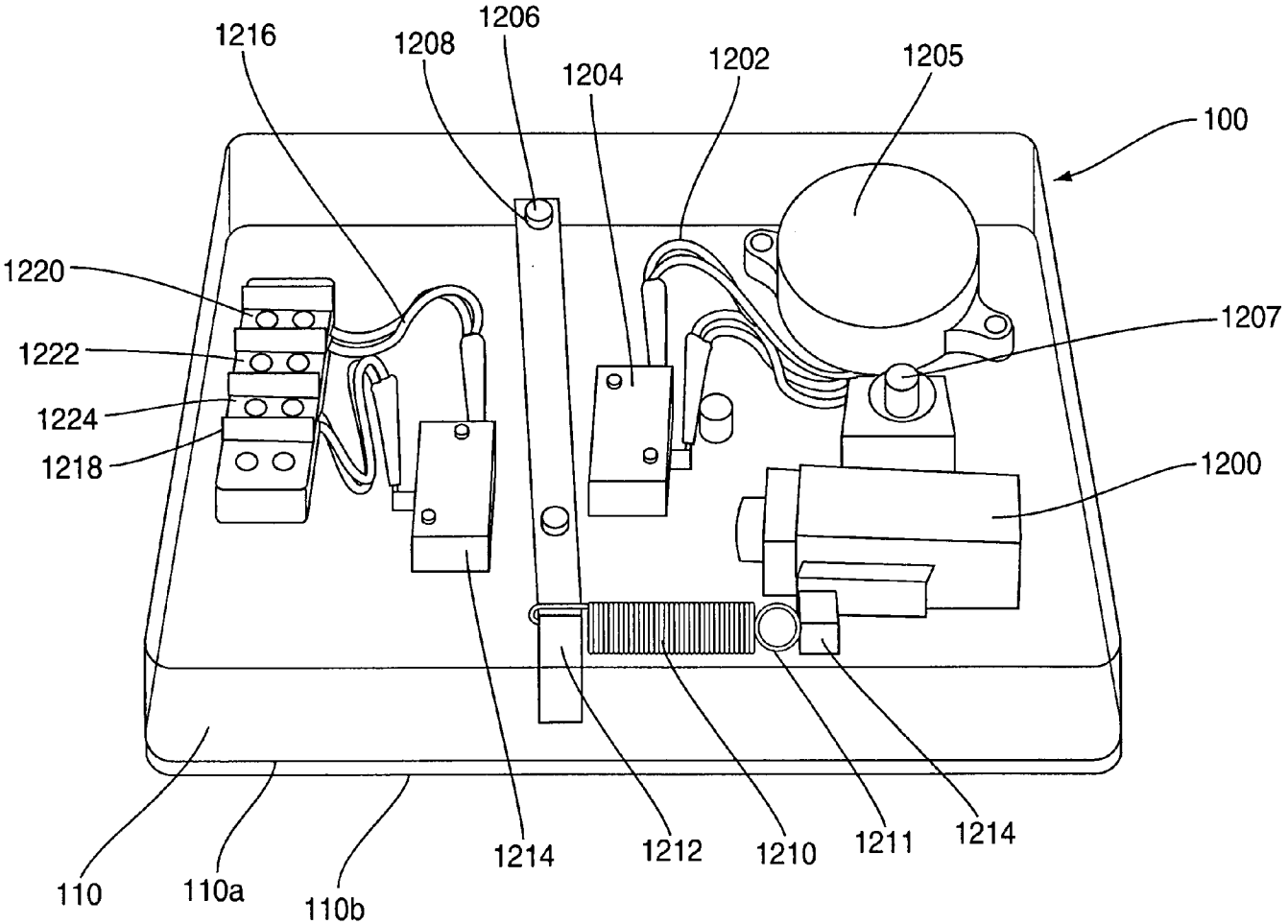
FIG. 12 is a top view diagram of an alternative embodiment of the water sensor using a microswitch to activate an alarm.
Figure 13:
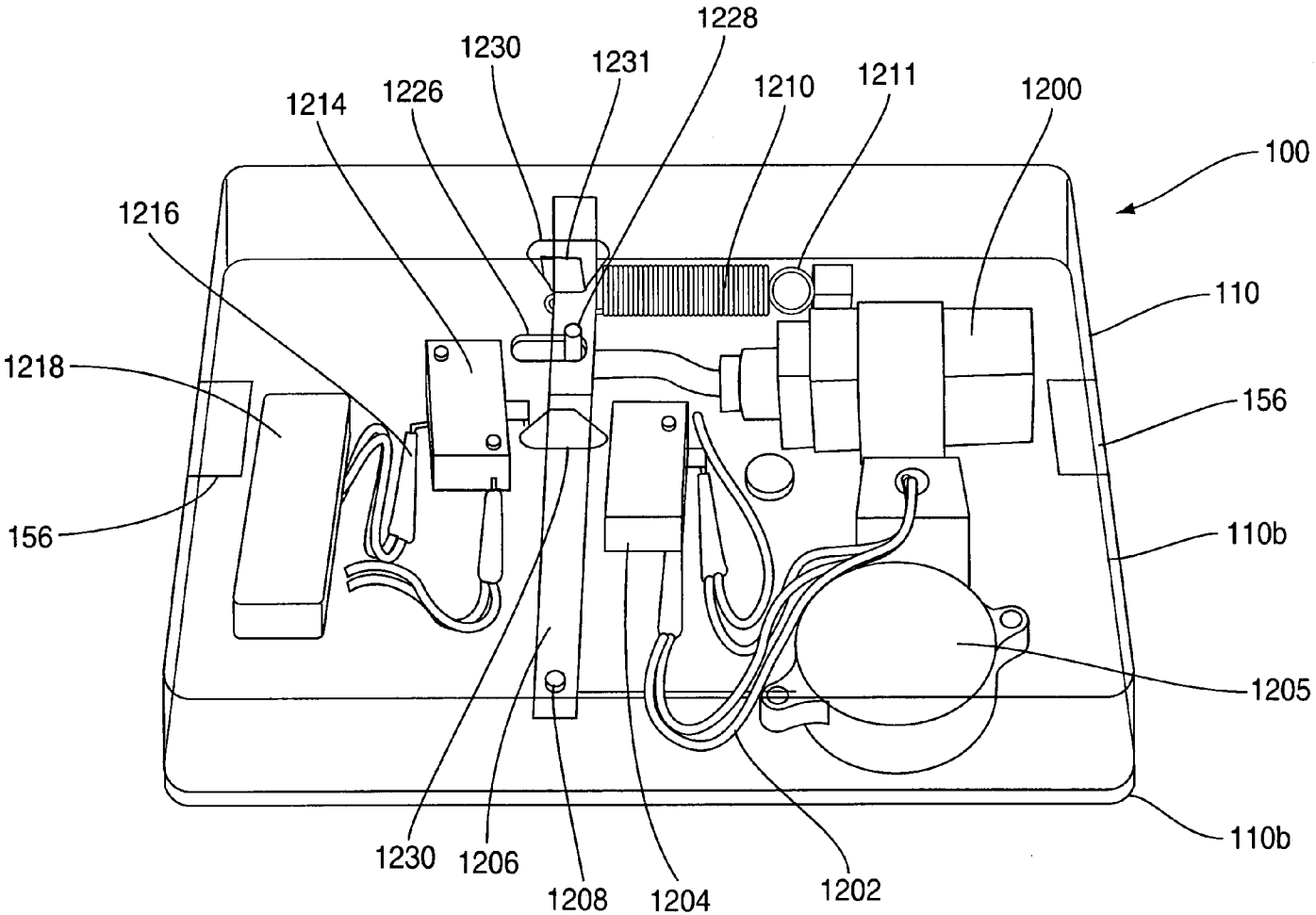
FIG. 13 is bottom view diagram of the water sensor illustrated in FIG. 12.

FIGS. 12–13 illustrate an alternative water sensor 100 that may be used in accordance with the present invention. Please note that all of the preceding information concerning the water sensor 100, including the trigger material 114, is equally applicable to this alternative water sensor 100 as well.

FIG. 12 illustrates a top view of the alternative water sensor 100. The water sensor 100 is comprised of a base 110 having a top side 110A and a bottom side 110B like that previously described in FIG. 1. The water sensor 100 includes a power supply or battery 1200 that is used to power an audible buzzer or horn 1205. The battery 1200 is connected to the horn 1205 via wiring coupling the horn 1205 to a micro switch 1204. The micro switch 1204 is a type of signaling apparatus and is normally open in the illustrated embodiment and causes the battery 1200 to connect to the horn 1205 when the micro switch 1204 is opened. The micro switch 1204 is closed when the water sensor 100 detect water or other liquid as will be described below. The battery 1200 is disconnected in FIG. 12 to prevent the horn 1200 from being activated as the water sensor 100 is not in a detection state. A test button 1207 is present to force a connection between the battery 1200 and the horn 1205 independent of the micro switch 1204 to determine if the water sensor battery 1200 still has power and/or the horn 1205 is properly operating.

A second micro switch 1214, another form of a signaling apparatus, is also included that is normally closed. The second micro switch 1214 is coupled to a terminal block 1218 via wiring 1216. When the second micro switch 1214 is closed, a connection is made in the terminal block 1218 between closed terminal 1224 and a common terminal 1222. When the micro switch 1214 is open, a connection is made between the open terminal 1220 and the common terminal 1222. As will be discussed below, detection of water or other liquid by the water sensor 100 will cause the second micro switch 1214 to open and couple the open terminal 1224 to the common terminal 1222. In this manner, the terminal block 1218 acts as a signaling apparatus, like that previously discussed above, an external electrical system can be connected to the terminal block 1218 to determine the status of the water sensor 100. When no liquid is detected, a connection is made between the closed terminal 1224 and the common terminal 1222 of the terminal block 1218. When liquid is detected, a connection is made between the open terminal 1220 and the common terminal 1222 of the terminal block 1218. The water sensor 100 may be connected to an external alarm or notification system to report a leak in lieu of or in addition to the horn 1200.

Similar to the embodiment of the water sensor 100 illustrated previously, the water sensor 100 illustrated in FIG. 12 includes a transfer arm 1206 that moves to transfer energy when water or other liquid is detected. The transfer arm 1206 is fixed at one end at fulcrum point 1208, and freely moves on its other end where a spring 1210 is coupled to the transfer arm 1206 via spring coupling 1212. The other end of the spring 1210 is coupled to a fixed block 1214 via spring coupling 1211. When the water sensor 100 is in a liquid detection state, the transfer arm 1206 is biased towards the second micro switch 1214 causing the micro switch 1214 to be closed while leaving the first micro switch 1204 open. The spring 1210 is in an expanded state thereby retaining potential energy to cause the transfer arm 1206 to be biased towards the first micro switch 1204. When water or other liquid is detected, as will be discussed below, the transfer arm 1206 moves towards the spring 1210 using the retained energy in the spring 1210 to open the second micro switch 1214 and close the first micro switch 1204.

When the first micro switch 1204 is closed, the battery 1200 is coupled to the horn 1205 to generate an audible sound. Likewise, when the second micro switch 1214 is open, a connection is made between the open terminal 1220 and the common 1222 so that an external electrical system coupled to the water sensor 100 can detect the presence of water or other liquid at the water sensor 100. FIG. 12 does not illustrate how the lack of presence of water or other liquid causes the transfer arm 1206 to expand the spring 1210 and the presence of water or other liquid causes the transfer arm 1206 to move towards the spring 1210. FIG. 13 illustrates the bottom view of the water sensor 100 illustrated in FIG. 12 to explain how a trigger material 114 is used to accomplish this functionality.

As illustrated in FIG. 13, an orifice 1226 is located in the bottom side 110B of the water sensor 100. A pin 1228 is connected to the bottom of the transfer arm 1206 on the end opposite from the fulcrum point 120 and extends through the orifice 1226 such that movement of the pin 1228 also cases the transfer arm 1206 to move back and forth along the perimeter of the orifice 1226. Two triangle-shaped retaining members or struts 1230 are provided, one on each side of the pin 1228, where both struts 1230 each have an intrusion 1231, where the intrusions 1231 of each strut 1230 face one another. The trigger material 114 (not shown), like that previously described above, is placed between the struts 1230 and held in place by the intrusions 1231 such that the pin 1228 is held to the left side of the orifice 1226 as illustrated in FIG. 13. This causes the transfer arm 1206 to be biased and expand the spring 1210.

As previously discussed above, when the trigger material 114 softens, dissolves or otherwise loses its rigidity, the pin 1228 will move towards the spring 1210 due to the force of the energy retained in spring 1210 overcoming the rigidity of the trigger material 114, thereby causing the first micro switch 1204 to close and the second micro switch 1214 to open thereby indicating a detection of water or other liquid. The water sensor bottom side 110B contains a plurality of legs 156 to raise the trigger material 114 as retained by the struts 1230 off of the ground so that water or other liquid can pass around the legs 156 and come into contact with the trigger material 114.

Figure 14A:
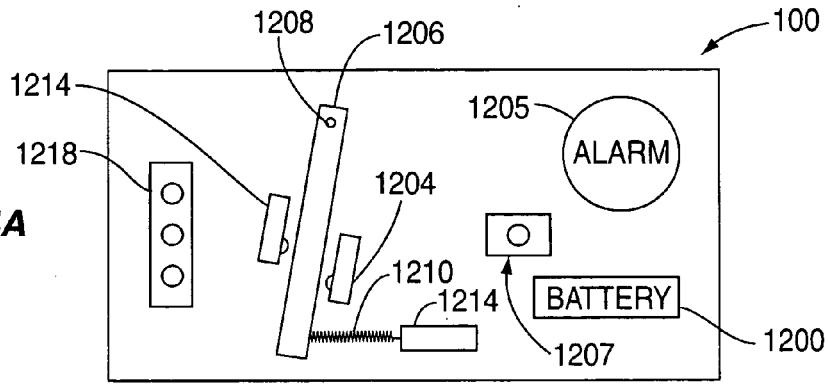
FIGS. 14A–14D illustrate the trigger arm arrangement for the water sensor illustrated in FIGS. 12–13.
Figure 14B:
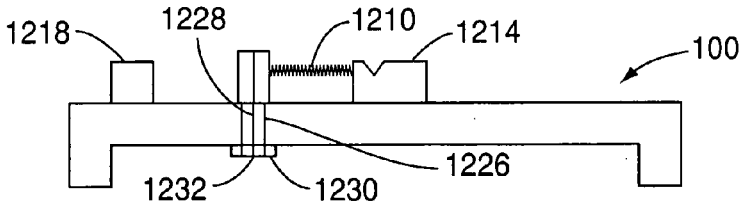
Figure 14C:
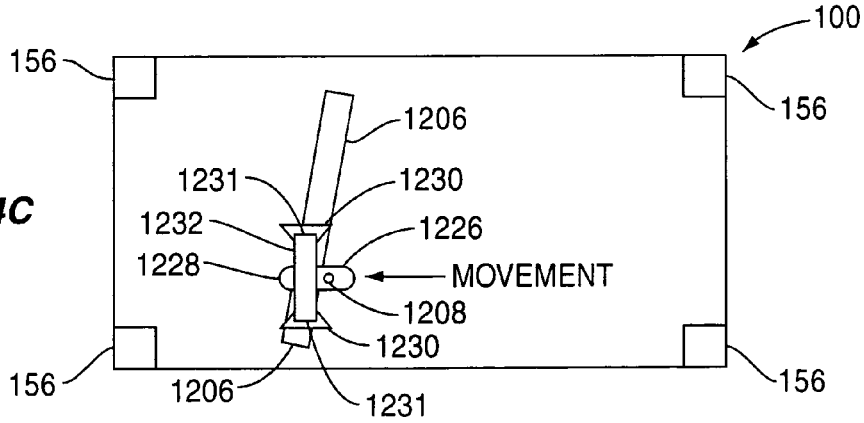
Figure 14D:
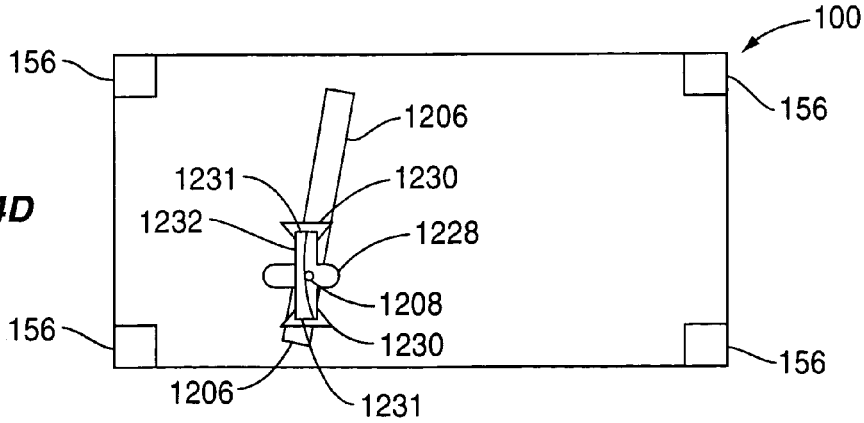

FIGS. 14A–14D illustrate the operation of the trigger material 114 in the water sensor 100 illustrated in FIGS. 12–13 to further expand upon the description of the operation above. In the top view of FIG. 14A, the transfer arm 1206 is illustrated as expanding the spring 1210 due to the trigger material 114 keeping the pin 1228 from moving towards the spring 1210. FIG. 14B illustrates a side view of FIG. 14A showing the transfer arm 1210 expanding the spring 1210 due to the trigger material preventing the pin 1228 from releasing the energy in the spring 1210 to move the transfer arm 1206 towards the spring 1210. FIG. 14C illustrates a bottom view of FIG. 14A showing the trigger material 114 preventing the pin 1228 and transfer arm 1206 from moving towards the spring 1210. FIG. 14D illustrates the trigger material 114 after it has come into contact with water or other liquid thereby softening where the energy stored in the spring 1210 is sufficient to cause the pin 1228 to move into the trigger material 114 and thus allow the transfer arm 1206 to move towards the spring 1206 to indicate a detection of water or other liquid.

Figure 15A:
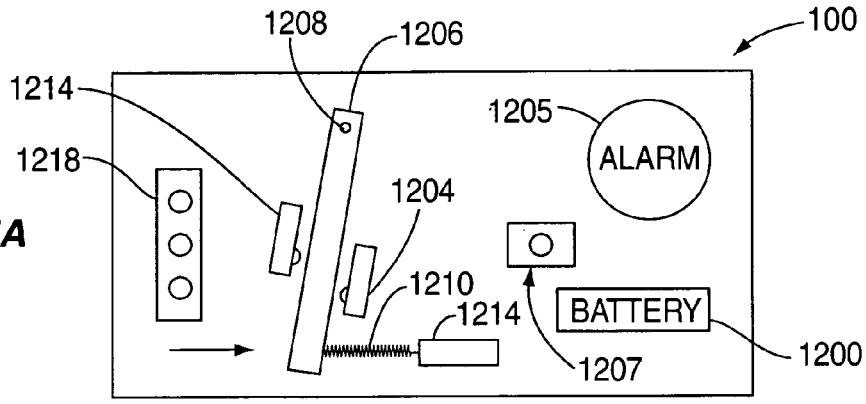
FIGS. 15A–15D illustrate an alternative trigger arm arrangement for the water sensor illustrated in FIGS. 12–13.
Figure 15B:
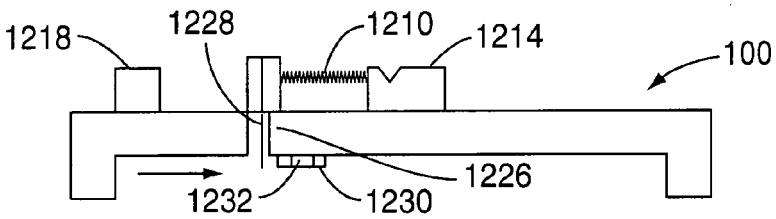
Figure 15C:
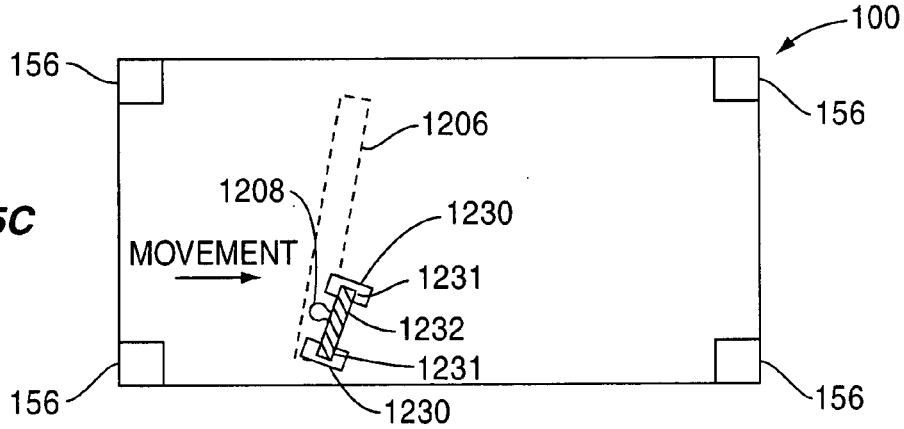
Figure 15D:
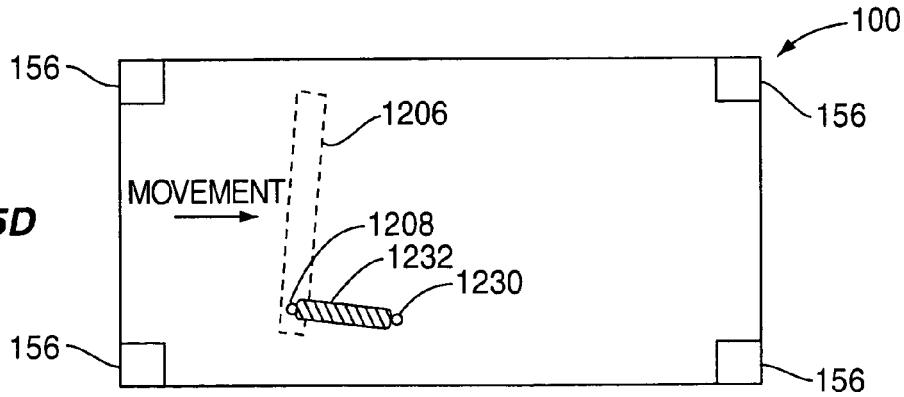

FIGS. 15A–15D illustrate an alternative placement of the struts 1230 to hold the trigger material 114 in place and prevent the pin 1228 from moving towards the spring 1210 when the trigger material 114 has not been contacted by water or other liquid. All discussion of FIGS. 14A–14D applies equally for FIGS. 15A–15D. The struts 1230 are arranged in a slanted orientation with respect to the water sensor base 100. This may be a preferable arrangement if the trigger material 114 encompasses characteristics that cause the trigger material 114 to lose more rigidity when a force is applied by the pin 1228 in a slanted direction rather than a straight-on direction against the trigger material 114 when in contact with water or other liquid. FIG. 15D illustrates an alternative trigger material 114 orientation where the trigger material 114 is turned ninety degrees in orientation from that illustrated in FIGS. 14A–14D, which again may be more preferable if the trigger material 114 loses its rigidity in one direction of force against the trigger material 114, but not the other.

Figure 16A:
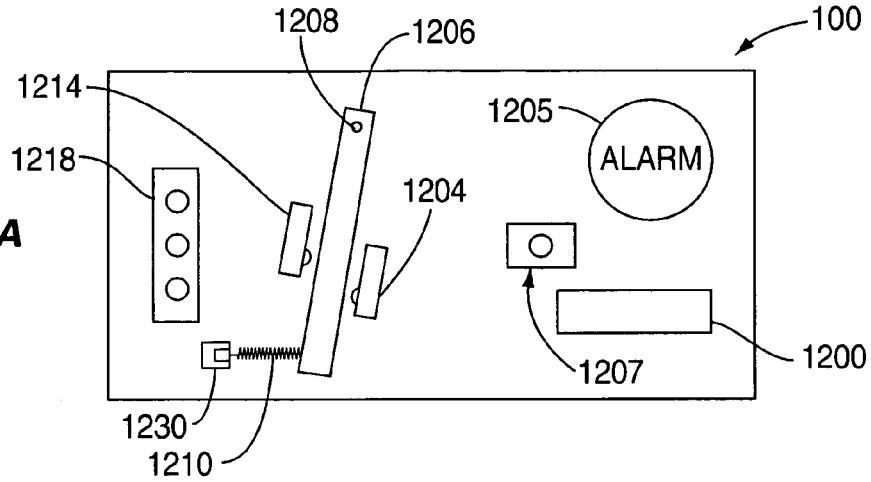
FIGS. 16A–16C illustrate a second alternative trigger arm arrangement for the water sensor illustrated in FIGS. 12–13.
Figure 16B:
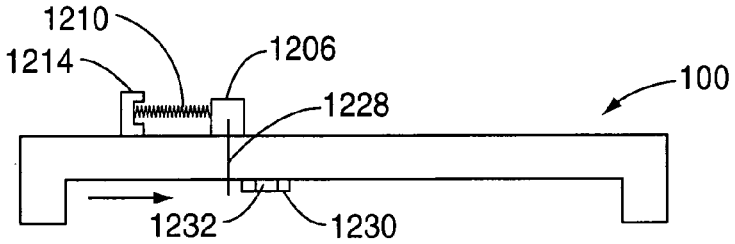
Figure 16C:
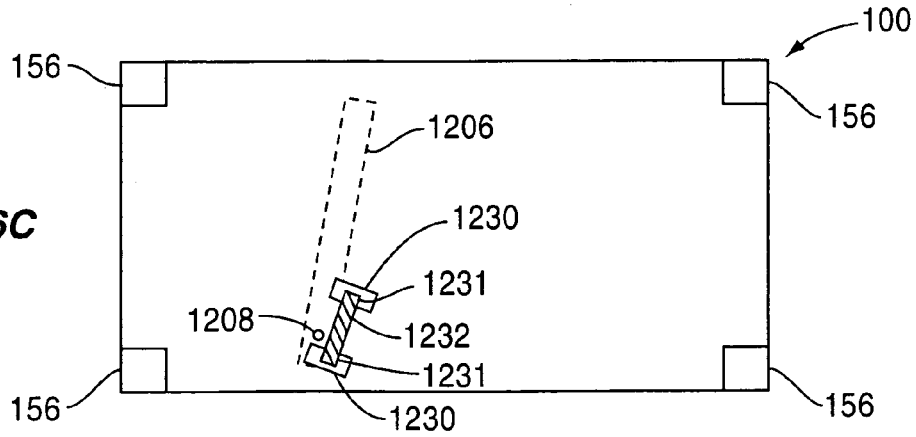

FIGS. 16A–16C illustrate another alternative arrangement for the transfer arm 1206 and the trigger material 114 where the spring 1210 is compressed rather than expanded when the water sensor 100 is in a state to detect the presence of water or other liquid. As illustrated in top view of the water sensor 100 in FIG. 16A, the spring 1210 is located on the left hand side of the transfer arm 1206 as opposed to the right hand side. When the trigger material 114 is placed between the struts 1230, the pin 1228 is forced closer to the spring 1210 thereby compressing the spring 1210 causing the spring 1210 to retain energy to release in the form of expansion. When the trigger material 114 comes into contact with water or other liquid and softens, the energy in the spring 1210 overcomes the rigidity of the trigger material 114 thereby forcing the pin 1228 and transfer arm 1206 to move away from the spring 1206 thereby expanding the spring. As discussed above, when the transfer arm 1206 moves, it causes the micro switches 1204, 1214 to indicate the presence of water or other liquid.

Figure 17A:
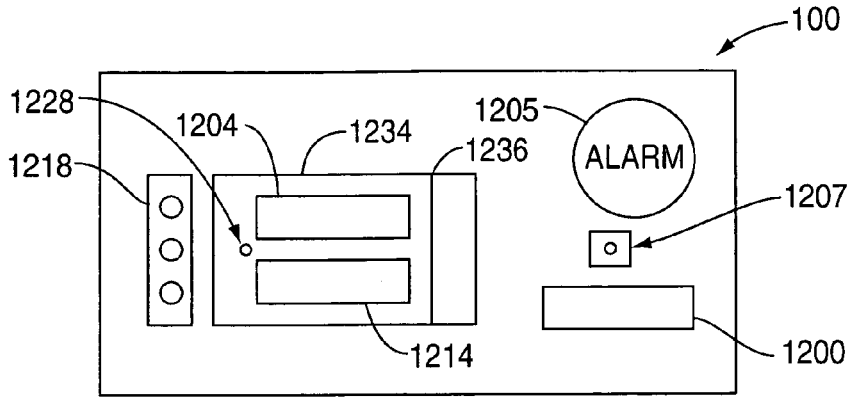
FIGS. 17A–17D illustrate a third alternative trigger arm arrangement for the water sensor illustrated in FIGS. 12–13.

FIGS. 17A–17D illustrate yet another embodiment of the water sensor 100 where the trigger material 114 is designed to expand in the presence of water or other liquid and cause a movement in the transfer arm 1206 to activate the micro switches 1204, 1214. As illustrated in FIG. 17A, a top view of the water sensor 100 is illustrated. The micro switches 1204, 1214 are aligned in a direction on top of each other instead of side-by-side as illustrated in the water sensor 100 of FIGS. 12–16. A transfer arm in the form of lever 1234 is located underneath each micro switch 1204, 1214, where the lever 1234 is fixed in place on one side at pivot 1236, and is free to move upward on the opposite side.

Figure 17B:
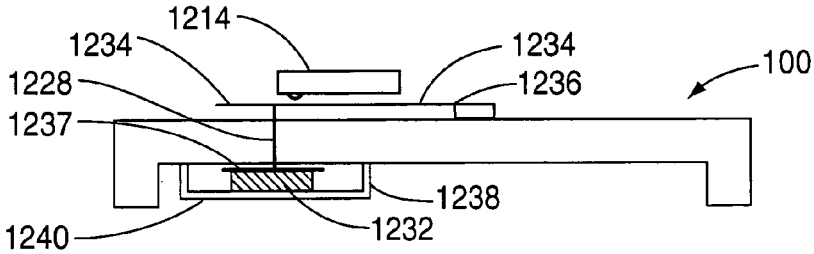

A top view of a pin 1228 is also illustrated that extends downward through the water sensor base 110 as illustrated in the side view in FIG. 17B. A trigger material 114 is housed in a holding container 1238. The pin 1228 is coupled to a base 1237 that rests on top of the trigger material 114 so that when the trigger material 114 comes into contact with water or other liquid, the trigger material 114 expands upward on the base 1237 to move the pin 1228 upward since it is bounded on its bottom side by a thin sheet of plastic 1240. The plastic 1240 is used so that the trigger material 114 can be serviced and replaced after detections occur.

When the trigger material 114 expands, its pushes pin 1228 upward thereby moving the lever 1234 upward. The lever 1234 is located underneath both micro switches 1204, 1214. The lever 1234 is held in place by pivot 1234. When the lever 1234 is pushed upward by the trigger material 114, the lever 1234 engages the micro switches 1204, 1214 and causes the horn 1205 to sound and the terminal 1218 to connect terminals to indicate detection of water or other liquid as previously discussed. FIG. 17C illustrates a larger side view of FIG. 17B for more clarity.

Figure 17D:
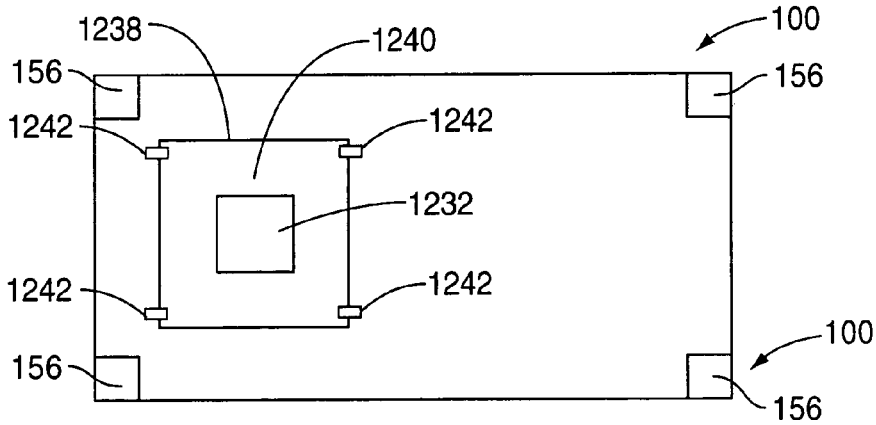
Figure 17C:
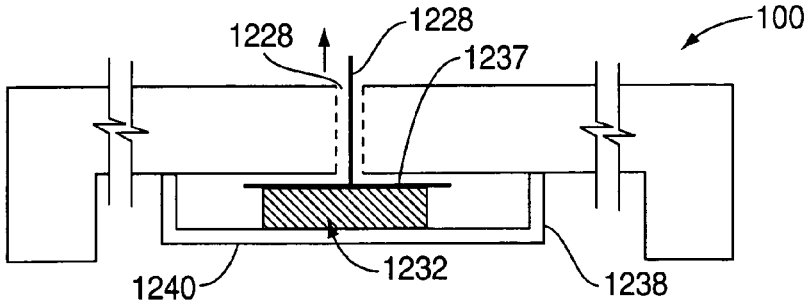

FIG. 17D illustrates a bottom view of the water sensor 100 illustrated in FIGS. 17A–17C. The trigger material 114 is held by a holder comprised of four posts 1242 holding a plastic sheet 1240. The plastic sheet may be 1/16 inches for example. The plastic sheet 1240 can be slid on top of the post 1242 when placing the water sensor 100 in condition for detection after the trigger material 114 is placed on top.

Figure 18:
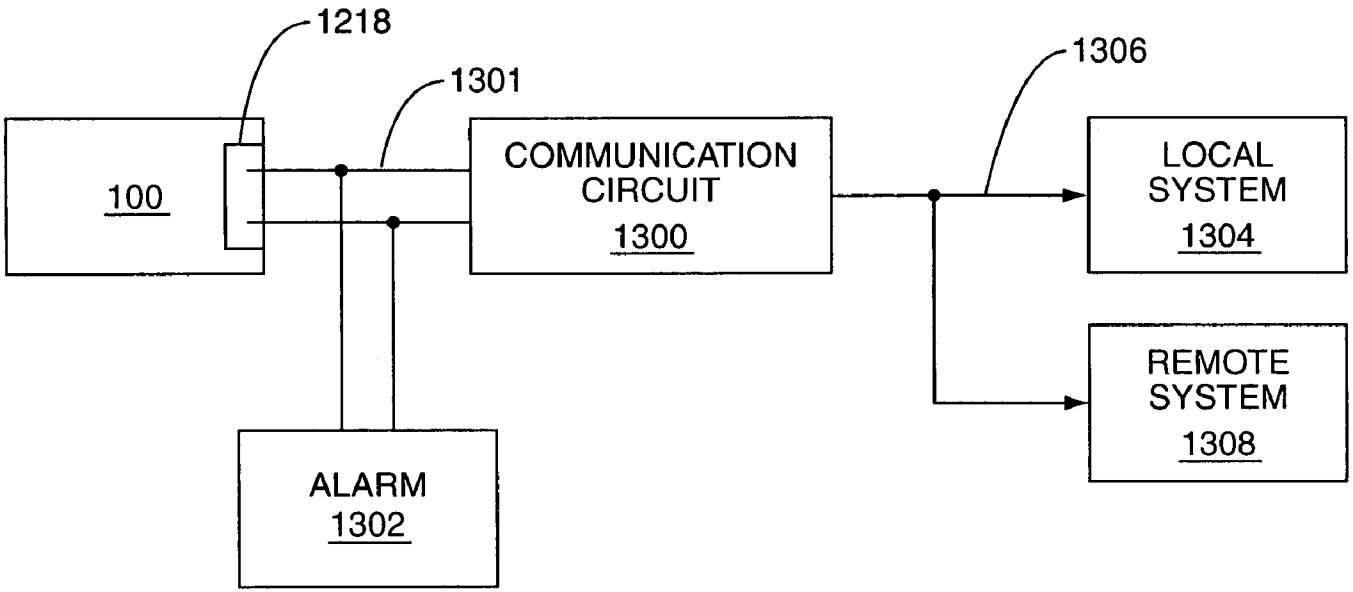
FIG. 18 illustrates a block diagram of a communication structure for the water sensors of the present invention.

FIG. 18 illustrates a block diagram of a communication structure for the water alarm 100 in order to indicate the detection of water or other liquid to other systems, such as an alarm or monitoring system. It may be desired for the water sensor 100 to communicate the detection of water or other liquid to another system since activating a horn 1205 may be futile if there is no human in range of the water sensor 100 to hear the horn 1205 and thereafter take corrective measures to alleviate the leak of water or other liquid.

The water sensor 100, via terminal block 1218, may be connected to an alarm system 1302 external to the water sensor 100 or to a communication circuit 1300 via communication line 1301. The communication circuit 1300 may either be wired or wireless. Examples of wired circuits 1300 may be a phone line, PSTN, Ethernet, twisted-pair, or other wired connection. Examples of wireless circuits 1300 may be a RF transceiver, a Bluetooth transceiver, or a transponder arrangement. The communication circuit 1300 may be coupled to a local system 1304 via communication line 1306 or to a remote system 1308 via communication line 1306. In this manner, the detection of the presence of water or other liquid by the water sensor 100 can be communicated to other systems for monitoring, notification so that corrective measures can be taken to alleviate the presences of water or other liquid in the location of the water sensor 100 where it is not desired, as previously discussed.

Those skilled in the art will recognize improvements and modifications to the preferred embodiments of the present invention. The term "water" is meant to mean water or other liquid, and other liquids are equivalent to water for the purposes of this invention and its claims. All such improvements and modifications are considered within the scope of the concepts disclosed herein and the claims that follow.

We claim:

1. A liquid sensor, comprising:

a base having a first side and a second side;

a retaining member affixed to said first side of said base;

a trigger material deformable by contact with liquid retained by said retaining member;

a transfer arm affixed to said second side of said base biased into contact with and immobilized by said trigger material thereby to retain potential energy; and a signaling apparatus wherein said signaling apparatus is activated by movement of said transfer arm; and whereby upon liquid contact with said trigger material, said trigger material deforms and said transfer arm in response thereto thereby activating said signaling apparatus.

2. The liquid sensor of claim 1 wherein said signaling apparatus is affixed to said second side of said base proximate to said transfer arm.

3. The liquid sensor of claim 1, further comprising:

a locking apparatus affixed to said second side of said base proximate to said transfer arm, having a locked position wherein said transfer arm is immobilized by said locking apparatus and an unlocked position wherein said transfer arm is immobilized by said trigger material.

4. The liquid sensor of claim 3 wherein said locking apparatus further comprises a cam rotatable between said locked position and said unlocked position.

5. The liquid sensor of claim 3 wherein said locking apparatus further comprises a hinged arm pivotable between said locked position and said unlocked position.

6. The liquid sensor of claim 3 wherein said locking apparatus further comprises a wedge positionable between said locked position and said unlocked position.

7. The liquid sensor of claim 3 wherein said transfer arm is resilient and affixed under tension to said second side of said base.

8. The liquid sensor of claim 3 wherein said transfer arm is substantially rigid and pivotally affixed to said second side of said base.

9. The liquid sensor of claim 8 wherein said transfer arm further comprises a compressed spring member having a first end and a second end, wherein said first end is affixed to said second side of said base proximate to said transfer arm and said second end pushes said transfer arm into contact with said trigger material.

10. The liquid sensor of claim 8 wherein said transfer arm further comprises a decompressed spring member having a first end and a second end, wherein said first end is affixed to said second side of said base proximate to said transfer arm and said second end is affixed under tension to said transfer arm, thereby to pull said transfer arm into contact with said trigger material.

11. The liquid sensor of claim 3 wherein said signaling apparatus further comprises:

a pneumatic tank that expels air upon activation by movement of said transfer arm; and a horn operably connected to said pneumatic tank to sound upon expulsion of air from said pneumatic tank.

12. The liquid sensor of claim 1 wherein said signaling apparatus further comprises an alarm.

13. The liquid sensor of claim 12 wherein said alarm is audible.

14. The liquid sensor of claim 12 wherein said alarm is visible.

15. The liquid sensor of claim 12 wherein said signaling apparatus further comprises a solenoid electrically coupled to said alarm.

16. The liquid sensor of claim 12 wherein said signaling apparatus further comprises a relay electrically coupled to said alarm.

17. The liquid sensor of claim 3 wherein said signaling apparatus sends a signal to a system comprised from the group consisting of a computer system, an alarm system, a local system and a remote system.

18. The liquid sensor of claim 3 wherein said signaling apparatus sends a signal wirelessly to another system.

19. The liquid sensor of claim 3 wherein said trigger material has a straight edge in contact with said transfer arm.

20. The liquid sensor of claim 3 wherein said transfer arm has a straight edge in contact with said trigger material.

21. The liquid sensor of claim 3 wherein said trigger material has a peaked edge in contact with said transfer arm.

22. The liquid sensor of claim 3 wherein said transfer arm has a peaked edge in contact with said trigger material.

23. The liquid sensor of claim 3 wherein said trigger material has a curved edge in contact with said transfer arm.

24. The liquid sensor of claim 3 wherein said transfer arm has a curved edge in contact with said trigger material.

25. The liquid sensor of claim 1 wherein said trigger material dissolves by contacting liquid.

26. The liquid sensor of claim 1 wherein said trigger material dissolves by contacting liquid.

27. The liquid sensor of claim 1 wherein said trigger material comprises a chemical tablet, foam, a sponge, and a spring.

28. The liquid sensor of claim 1 wherein said trigger material is comprised from a material comprised from the group consisting of starch, sugar, gelatin, and polyvinylacetate (PVA).

29. The liquid sensor of claim 3, further comprising a shield affixed to said base with said trigger material between said base and said shield.

30. The liquid sensor of claim 3, further comprising:
a plurality of guides, affixed to said base; and
a plurality of channels defined by said plurality of guides, thereby to direct liquid toward said trigger material.

31. The liquid sensor of claim 29, further comprising:
a plurality of guides, affixed to said base; and
a plurality of channels defined by said plurality of guides, thereby to direct liquid toward said trigger material.

32. The liquid sensor of claim 1 wherein said signaling apparatus generates a contact or a signal.

33. The liquid sensor of claim 1 wherein said signaling apparatus is a switch or a micro switch.

34. The liquid sensor of claim 1 wherein said transfer arm is substantially rigid and pivotally affixed to said second side of said base.

35. The liquid sensor of claim 34 wherein said transfer arm further comprises a compressed spring member having a first end and a second end, wherein said first end is affixed to said second side of said base proximate to said transfer arm and said second end pushes said transfer arm into contact with said trigger material.

36. The liquid sensor of claim 35 wherein said signaling apparatus is a micro switch wherein said transfer arm activates said micro switch when said transfer arm contacts said micro switch.

37. The liquid sensor of claim 36 wherein activation of said micro switch creates a contact between a common terminal and another terminal on a terminal block.

38. The liquid sensor of claim 36 wherein activation of said micro switch activates a contact between a power supply and a horn.

39. The liquid sensor of claim 38 further comprising a second micro-switch wherein said transfer arm activates said second micro switch when said transfer arm contacts said micro switch wherein activation of said second micro switch creates a contact between a common terminal and another terminal on a terminal block.

40. The liquid sensor of claim 34 wherein said transfer arm further comprises a decompressed spring member having a first end and a second end, wherein said first end is affixed to said second side of said base proximate to said transfer arm and said second end is affixed under tension to said transfer arm, thereby to pull said transfer arm into contact with said trigger material.

41. The liquid sensor of claim 40 wherein said signaling apparatus is a micro switch wherein said transfer arm activates said micro switch when said transfer arm contacts said micro switch.

42. The liquid sensor of claim 40 wherein activation of said micro switch creates a contact between a common terminal and another terminal on a terminal block.

43. The liquid sensor of claim 41 wherein activation of said micro switch activates a contact between a power supply and a horn.

44. The liquid sensor of claim 43 further comprising a second micro-switch wherein said transfer arm activates said second micro switch when said transfer arm contacts said micro switch wherein activation of said second micro switch creates a contact between a common terminal and another terminal on a terminal block.

45. The liquid sensor of claim 1 wherein said retaining member retains the trigger material oriented in a direction with said transfer arm from the group of orientations consisting of parallel, perpendicular, and angled.

46. The liquid sensor of claim 1 wherein said transfer arm moves towards said trigger material when said trigger material deforms when in contact with said liquid.

47. The liquid sensor of claim 1 wherein said trigger material expands when in contact with liquid and said trigger material moves said transfer arm upward to activate said signaling apparatus.

48. The liquid sensor of claim 47 wherein said trigger material is held in place by a holding container.

49. The liquid sensor of claim 48 wherein said holding container is comprised of a plurality of posts that retain a thin sheet placed between said plurality of posts.

50. The liquid sensor of claim 47 wherein said signaling apparatus is a switch.

51. The liquid sensor of claim 50 wherein activation of said micro switch creates a contact between a common terminal and another terminal on a terminal block.

52. The liquid sensor of claim 50 wherein activation of said micro switch activates a contact between a power supply and a horn.

53. The liquid sensor of claim 52 further comprising a second micro-switch wherein said transfer arm activates said second micro switch when said transfer arm contacts said micro switch wherein activation of said second micro switch creates a contact between a common terminal and another terminal on a terminal block.

54. A method for sensing the presence of liquid, comprising:
retaining a trigger material deformable by contact with liquid;
biasing a transfer arm affixed to said base into contact with and immobilized by said trigger material, thereby retaining potential energy;
contacting said trigger material with liquid;
deforming said trigger material upon contact with said liquid;
moving said transfer arm upon deformation of said trigger material, thereby converting said potential energy to kinetic energy;
activating a signaling apparatus with said kinetic energy upon movement of said transfer arm; and
transmitting a signal upon activation of said signaling apparatus.

55. The method of claim 54, further comprising immobilizing said transfer arm, upon removal of said trigger material from being retained, with a locking apparatus affixed to said base.

56. The method of claim 54 wherein said activating is further comprised of activating a switch.

57. The method of claim 56 wherein said activating is further comprised of activating a second switch.

58. The method of claim 56, further comprising causing a contract between two terminals when said second switch is activated.

59. The method of claim 57 further comprising causing a connection between a power supply and a horn when said switch is activated.

60. The method of claim 54, further comprising immobilizing said transfer arm, upon removal of said trigger material from being retained, with a locking apparatus affixed to said base.

61. The method of claim 54, further comprising signaling engagement of said activated state by said transfer arm.

62. The method of claim 61 wherein said signaling engagement further comprises sounding an air horn operably connected to said transfer arm.

63. The method of claim 61 wherein said signaling engagement further comprises sounding an audible alarm operably connected to said transfer arm.

64. The method of claim 61 wherein said signaling engagement further comprises sounding a visible alarm operably connected to said transfer arm.

65. The method of claim 61 wherein said signaling engagement further comprises transmitting an instruction to a system comprised from the group consisting of a computer system, an alarm system, a local system and a remote system.

66. The method of claim 54, further comprising moving said transfer arm toward said trigger material.

67. The method of claim 54 wherein said transfer material expands to move said transfer arm upward into said signaling apparatus.

68. A system for detecting liquid, said system comprising:

a water-based appliance receiving a supply of water; and a water detection apparatus operably connected to said water-based appliance, said water detection apparatus further comprising:

a base having a first side and a second side;

a retaining member affixed to said first side of said base;

a trigger material, deformable by contact with water retained by said retaining member;

a transfer arm affixed to said second side of said base biased into contact with and immobilized by said trigger material, thereby to retain potential energy; and a signaling apparatus, affixed to said second side of said base proximate to said transfer arm, activated by movement of said transfer arm, thereby to transmit a signal upon activation; and whereby upon water contact with said trigger material, said trigger material deforms and said transfer arm moves toward said trigger material, thereby activating said signaling apparatus to transmit said signal.

69. The system of claim 68 wherein said water detection device suspends the supply of water to said water-based appliance upon engagement of said activated state by said transfer arm.

70. The system of claim 68 wherein said water detection device suspends a supply of flammable gas proximate said water-based appliance upon engagement of said activated state by said transfer arm.

71. The system of claim 68 wherein said water detection device suspends electrical power proximate said water-based appliance upon engagement of said activated state by said transfer arm.

72. The system of claim 70 wherein said water-based appliance is a gas-heated hot-water heater.

73. The system of claim 71 wherein said water-based appliance is an electric heated hot-water heater.

* * * * *